US007074538B2

(12) United States Patent
Hosoi et al.

(10) Patent No.: US 7,074,538 B2
(45) Date of Patent: Jul. 11, 2006

(54) IMAGE FORMING METHOD

(75) Inventors: Kiyoshi Hosoi, Kanagawa (JP); Ashita Murai, Shizuoka-ken (JP); Yasutomo Goto, Shizuoka-ken (JP)

(73) Assignees: Fuji Xerox Co., Ltd., Tokyo (JP); Fuji Photo Film Co., Ltd., Kanagawa (JP)

( * ) Notice: Subject to any disclaimer, the term of this patent is extended or adjusted under 35 U.S.C. 154(b) by 142 days.

(21) Appl. No.: 10/738,251

(22) Filed: Dec. 18, 2003

(65) Prior Publication Data

US 2004/0191664 A1 Sep. 30, 2004

(30) Foreign Application Priority Data

Dec. 19, 2002 (JP) ..... 2002-368818

(51) Int. Cl.
*G03G 13/20* (2006.01)

(52) U.S. Cl. ..... 430/124; 428/507; 428/511; 428/512; 428/513

(58) Field of Classification Search ..... 430/124; 428/507, 511, 512, 513
See application file for complete search history.

(56) References Cited

U.S. PATENT DOCUMENTS 5,252,531 A * 10/1993 Yasuda et al. ..... 428/513
5,900,115 A * 5/1999 Kuroyama et al. ..... 428/32.2

FOREIGN PATENT DOCUMENTS

| | | |
|---|---|---|
| JP | B 4-31389 | 5/1992 |
| JP | B 4-31393 | 5/1992 |
| JP | A 5-127413 | 5/1993 |
| JP | A 5-216322 | 8/1993 |
| JP | A 6-011982 | 1/1994 |
| JP | A 2002-91048 | 3/2002 |

* cited by examiner

*Primary Examiner*—Mark A. Chapman
(74) *Attorney, Agent, or Firm*—Morgan, Lewis & Bockius, LLP

(57) ABSTRACT

The invention provides an image forming method, comprising transferring a toner image to an electrophotographic recording sheet, layering the electrophotographic recording sheet on a fixing belt and heating and pressing the sheet, and cooling the electrophotographic recording sheet and separating the sheet from the fixing belt. The electrophotographic recording sheet comprises a support comprising cellulose pulp-containing base paper and a toner image-receiving layer comprising a thermoplastic resin disposed on the support. A shrinkage percentage of the electrophotographic recording sheet in a CD direction in the heating step is 1.3% or less. The support preferably further comprises either a polyolefin-containing layer or a coating that contains at least one selected from the group consisting of kaolin, a pigment, a resin, a rubber latex, or a polymer material and that is provided on one or both surfaces of the base paper.

17 Claims, 4 Drawing Sheets

IMAGE FORMING METHOD

CROSS-REFERENCE TO RELATED APPLICATIONS

This application claims benefit of and priority to Japanese Patent Application No. 2002-368818, filed on Dec. 19, 2002, which is incorporated herein by reference in its entirety for all purposes.

BACKGROUND OF THE INVENTION

1. Field of the Invention

The present invention relates to an image forming method, which is performed in apparatuses such as color copiers and color printers using an electrophotographic system.

2. Description of the Related Art

In conventional electrophotographic color image-forming apparatuses, such as color copiers and color printers, a single photoconductor drum is provided, on which respective toner images of colors such as yellow (Y), magenta (M), cyan (C), and black (BK) are successively formed. The toner image are then transferred to and superimposed on a recording sheet, and then thermally fixed onto the recording sheet to form a color image. In certain color image-forming apparatuses, respective toner images of colors such as in Y, M, C, and BK are successively formed on a photoconductor drum, then temporarily transferred to and superimposed on an intermediate transfer body, after which they are transferred to a recording sheet all at once, and thermally fixed onto the recording sheet to form a color image.

There are also color image-forming apparatuses that have different image-forming units corresponding to each of, for example, Y, M, C, and BK. Toner images of Y, M, C, and BK are each formed on the photoconductor drum of each image-forming unit successively and then transferred to and superimposed on a recording sheet; or temporarily transferred to and superimposed on an intermediate transfer body and then transferred to a recording sheet all at once. The toner images are then thermally fixed onto the recording sheet to form a color image.

In general, the color toners, which are to be transferred and fixed onto the recording sheet, are produced by dispersing or fusing and mixing colorants of a pigment, a dye or the like into a binder resin. The particle diameter of the toners is set at between several μm to several dozen μm. Such color toners are transferred to and superimposed on a piece of normal paper or coated paper such as general printing paper and then thermally fused and fixed onto the paper sheet.

A fixing device widely used in electrophotographic color copiers and printers is a roll fixing unit in which a fixing roll and a press roll are configured so as to be opposite each other. Fixation is performed between these rolls at a preset temperature under a preset load. The surface of the color image fixed in such a roll fixing unit has an irregularity of between 10 to 100 μm, which results from toner layer fluctuation and causes unevenness in gloss. Such color images formed on normal paper or coated paper reflect light irregularly and when viewed with the naked eye, exhibit poor in glossiness.

In light of this problem, Japanese Patent Application Publication (JP-B) Nos. 04-31389 and 04-31393 disclose a belt fixing unit for producing high glossiness, in which a sheet is placed on the surface of a toner image on a support after the fixation in an image forming apparatus, then heated and pressed so that the toner image is fused again, and then cooled and peeled.

These proposed techniques can improve gloss development, however, cannot produce both uniform high gloss image or flat images, not to mention photorealistic images.

The prior art for producing photorealistic images in the electrophotographic system includes a method wherein a transfer sheet that comprises a substrate and a 50–100 μm thick transparent resin layer formed on the substrate is used. The toner image is embedded into the transparent resin layer with a heat roll fixing unit so that irregularities in the toner layer can be reduced and the glossiness of the color image can be improved. Japanese Patent Application Laid-Open (JP-A) No. 05-127413 discloses a method wherein the toner image is transferred to an image transfer sheet that comprises a transparent resin layer of a tetrahydrofuran-soluble crosslinked resin with a glass transition temperature of 40 to 70° C.; the toner image is embedded into the transparent layer by means of a belt-type fixing unit. Additionally, JP-A Nos. 05-216322, 06-11982 and 2002-91048 disclose methods where the toner image is transferred to an image transfer sheet comprising a thermoplastic resin coating, and embedded into the transparent resin layer with a belt-type fixing unit.

The technologies disclosed in these publications involve fixing the color toner image onto the transfer sheet by pressing the color toner image with a heat roll so that the image is heated and fused into the transparent resin layer of the transfer sheet surface. Such processes can provide a color image with little surface irregularity and reduced diffuse light reflection, thereby producing a high-quality color image with no fluctuation in gloss.

Nonetheless, in the methods disclosed in JP-A Nos. 05-127413, 05-216322, 06-11982, and 2002-91048, if the recording sheet shrinks significantly during the heating and fixing process in the belt-type fixing unit, adhesion between the recording sheet and the belt-type fixing unit can be reduced, causing the recording sheet to easily peel off from the fixing unit. Accordingly, these processes have the potential to cause deterioration of high glossiness or uniform gloss on the toner image-receiving layer and the image portion. This in turn can cause peeling of the recording sheet before the separation point, causing jamming of the recording sheet in the apparatus.

SUMMARY OF THE INVENTION

The present invention has been made in order to solve the above problems with the prior art. The invention provides a method of forming an electrophotographic image, whereby the toner image-receiving layer and the image portion can have high and uniform gloss in an electrophotographic record sheet.

In order to achieve high and uniform gloss of the toner image-receiving layer and the image portion of the electrophotographic record sheet, the present inventors have made active investigations into the thermal shrinkage of electrophotographic recording sheets in a CD direction. As a result of these investigations, the inventors have found a solution and completed the invention.

Thus, one aspect of the invention is to provide an image forming method, comprising:

transferring a toner image to an electrophotographic recording sheet;

layering the electrophotographic recording sheet on a fixing belt and heating and pressing the sheet; and cooling the electrophotographic recording sheet and separating the sheet from the fixing belt, wherein the electrophotographic recording sheet comprises a support comprising cellulose pulp-containing base paper and a toner image-receiving layer comprising a thermoplastic resin disposed on the support, and wherein a shrinkage percentage of the electrophotographic recording sheet in a CD direction in the heating step is 1.3% or less.

Another aspect of the invention is to provide an image forming method characterized in that the support has a polyolefin-containing layer on one or both sides thereof.

DETAILED DESCRIPTION OF THE INVENTION

Figure 1:
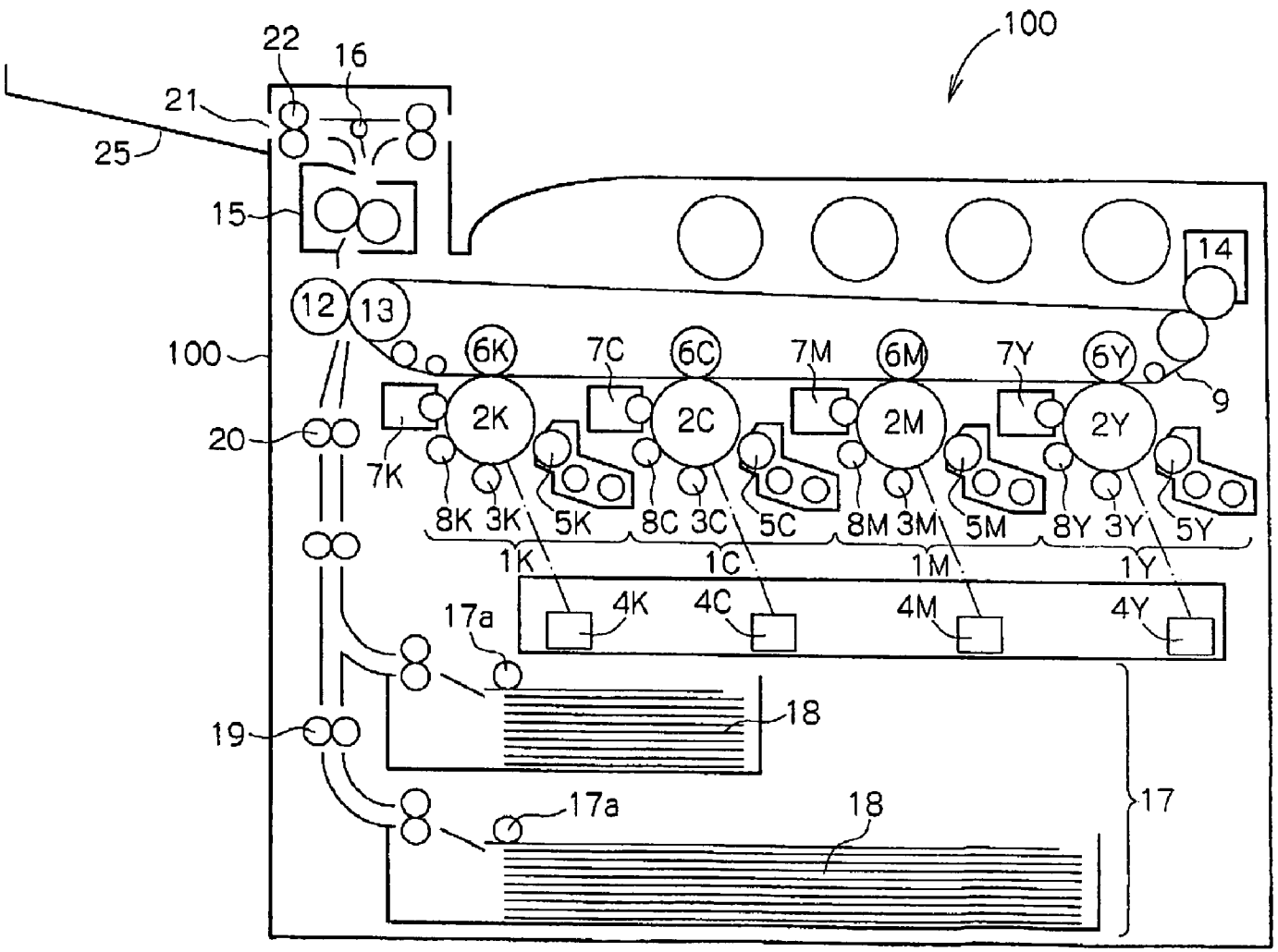
FIG. 1 is a schematic diagram showing an example of an image forming apparatus for use in the method of the invention.

The present invention is described in detail below.

The image forming method of the invention comprises a fixing process including the steps of: transferring a toner image to an electrophotographic recording sheet; layering the electrophotographic recording sheet on a fixing belt and heating and pressing the sheet; and cooling the electrophotographic recording sheet and separating the sheet from the fixing belt. The electrophotographic recording sheet comprises a support comprising cellulose pulp-containing base paper and a toner image-receiving layer comprising a thermoplastic resin disposed on the support. A shrinkage percentage of the electrophotographic recording sheet in a CD direction in the heating step is 1.3% or less.

In order to improve high and uniform gloss of the toner image-receiving layer and the image portion, it is necessary that the electrophotographic recording sheet sufficiently adhere to the fixing belt until the sheet is cooled and separated from the belt. Conventional electrophotographic recording sheets, which are made of cellulose pulp base paper, can significantly shrink in the CD direction when heated in the fixing process, causing them to insufficiently adhere to the fixing belt. In contrast, the image forming method of the invention uses an electrophotographic recording sheet that comprises at least one toner image-receiving layer formed on cellulose pulp paper and shows 1.3% or less of a shrinkage percentage of the electrophotographic recording sheet in a CD direction in the heating step. This limits the shrinkage of the medium in the CD direction to a low level in the fixing process, making it possible for the recording sheet to sufficiently adhere to the fixing belt so that the toner image-receiving layer and the image portion of the electrophotographic record sheet have high and uniform gloss. Further, the fixing process, the shrinkage of the heated medium in the CD direction can be reduced to a low level so that the medium sufficiently adheres to the fixing belt. Therefore, the toner image-receiving layer and the image portion can be made to have sufficiently high and uniform gloss, while suppressing bump formation between the toner image-receiving layer and the image portion. In such a process, unwanted peeling of the electrophotographic record sheet from the fixing belt can be prevented so as to not cause jamming of the sheet, which would otherwise occur before the separation point.

In the image forming method of the invention, the electrophotographic recording sheet may comprise a support comprising cellulose pulp base paper with a polyolefin layer formed on the surface thereon (i.e., a polyolefin layer-laminated paper support). Use of such a sheet enhances high and uniform gloss. Electrophotographic Recording Sheet The electrophotographic recording sheet shows a shrinkage percentage in the CD direction of 1.3% or less, preferably 1.0% or less, and more preferably 0.8% or less. As regards to the invention, the shrinkage percentage in the CD direction is produced during a heating process. Such a heat shrinkage percentage in the CD direction can be determined by the method outlined below.

Using a measurement apparatus (TMA 7000 (trade name) manufactured by Shinku-Riko Inc. (now known as ULVAC-Riko Inc.)), the measurement is performed under the conditions of: a temperature ranging of from 23° C. to 125° C.; a heating rate of 5° C./min; and a load of 1 g. A specimen with a width of 5 mm and a length of 15 mm (the long side being the CD direction) is allowed to stand under the conditions of 23° C. and 50% RH for 24 hours before the measurement. Based on the above measurement conditions, the specimen is heated from a standard temperature of 23° C. to 125° C. at a heating rate of 5° C. per minute so that it is allowed to shrink. The heat shrinkage amount at 125° C. is determined based on the length at 23° C., and the heat shrinkage percentage is calculated according to the following formula: shrinkage percentage (%)=shrinkage amount at 125° C./specimen length. In a paper-based material mainly composed of pulp fibers, the fibers included therein generally have the same direction orientation as the paper machine flow (machine direction, MD). The direction perpendicular (cross) to the MD direction is the cross direction (CD).

Examples of methods for reducing the heat shrinkage percentage in the CD direction include mixing synthetic pulp made of plastic with base paper (cellulose pulp paper); reducing the degree of beating of base paper (cellulose paper) pulp; reducing the fiber orientation ratio of base paper (cellulose pulp paper); reducing the water content of the base paper (cellulose pulp paper); and applying or laminating a thermoplastic resin onto one or both surfaces of base paper (cellulose pulp paper). Specific examples thereof are described below.

The electrophotographic recording sheet is structured so as to comprise the following: a cellulose pulp paper-based support and a toner image-receiving layer that includes at least one thermoplastic resin layer formed on the support. Optional layers may also be included, such as a protective layer, an intermediate layer, an undercoat layer, a cushion layer, a charge control (antistatic) layer, a reflective layer, a tint control layer, a storage stability improving layer, an anti-adhesion layer, an anti-curl layer, and a smoothing layer. Each of these layers may have a monolayer structure.

Any cellulose pulp paper (hereinafter also referred to as "base paper") may be appropriately selected accordingly to use and used for the support. Examples of such paper include base paper; coated paper comprising base paper and a coating layer provided thereon, such as coated paper for printing and art paper; and laminated paper comprising a resin layer laminated on one or both sides thereof. Any of these supports may have a monolayer structure or a two- or more-layer structure.

Base Paper

Any known material that has been used for a support may be selected and used for the base paper. For example, such a material includes natural pulp selected from softwood pulp and hardwood pulp. For the purpose of reducing the heat shrinkage in the CD direction, the natural pulp may be mixed with synthetic pulp made of a plastic material such as polyethylene and polypropylene.

The pulp material for the base paper is preferably bleached hardwood kraft pulp (LBKP) because it can increase the surface smoothness, stiffness and dimensional stability (against curling) of the base paper to a sufficient level at the same time in a well-balanced manner. However, bleached softwood kraft pulp (NBKP), hardwood sulfite pulp (LBSP) or the like may also be used.

Hardwood pulp fibers are originally relatively short, and therefore such hardwood pulp can suitably be used as a main component. A beater, a refiner or the like may be used for beating pulp. After the beating of pulp, if necessary, the resulting pulp slurry (hereinafter also referred to as "pulp stuff") may be mixed with any additive such as a filler, a dry paper strength additive, a sizing agent, a wet paper strength additive, a fixing agent, a pH regulator, and any other agent.

In order to reduce the heat-shrinkage in the CD direction, it is necessary to reduce the bond area between the fibers. Therefore, the degree of pulp beating should preferably be reduced to a low level, and the freeness may be controlled to be in a range from 400 ml to 500 ml.

In order to reduce the heat-shrinkage in the CD direction, it is necessary to reduce the fiber orientation ratio in the process of making base paper, for example, by changing a speed or an angle of the pulp slurry sprayed from a head box to wires or by controlling the wire speed. The fiber orientation ratio may be 1.4 or less, preferably 1.3 or less, more preferably 1.2 or less.

Examples of the filler include calcium carbonate, clay, kaolin, china clay, talc, titanium oxide, diatomaceous earth, barium sulfate, aluminum hydroxide, and magnesium hydroxide.

Examples of the dry paper strength additive include cationized starch, cationized polyacrylamide, anionized polyacrylamide, amphoteric polyacrylamide, and carboxy-modified polyvinyl alcohol.

Examples of the sizing agent include a fatty acid salt, rosin, a rosin derivative such as maleinized rosin, paraffin wax, an alkylketene dimer (AKD), alkenyl succinic anhydride (ASA), and a higher fatty acid-containing compound such as an epoxidized fatty acid amide.

Examples of the wet paper strength additive include polyamine polyamide epichlorohydrin, a melamine resin, a urea resin, and an epoxidized polyamide resin.

Examples of the fixing agent include a polyvalent metal salt such as aluminum sulfate and aluminum chloride and a cationic polymer such as cationized starch.

Examples of the pH regulator include sodium hydroxide and sodium carbonate. Examples of the any other additive include an anti-foaming agent, a dye, a slime-controlling agent, and a fluorescent brightening agent.

For example, a treatment solution for use in the surface sizing treatment may contain a water-soluble polymer, a sizing agent, a water-resistant material, a pigment, a pH regulator, a dye, a fluorescent brightening agent, and the like. Examples of the water-soluble polymer include cationized starch, polyvinyl alcohol, carboxy-modified polyvinyl alcohol, carboxymethylcellulose, hydroxyethylcellulose, cellulose sulfate, gelatin, casein, sodium polyacrylate, a sodium salt of a styrene-maleic anhydride copolymer, and sodium polystyrene sulfonate.

Examples of the water-resistant material include latex emulsions of a styrene-butadiene copolymer, an ethylene-vinyl acetate copolymer, polyethylene, a vinylidene chloride copolymer, or the like; and polyamide polyamine epichlorohydrin.

Examples of the pigment include calcium carbonate, clay, kaolin, talc, barium sulfate, and titanium oxide.

Examples of the material for the base paper include natural pulp paper as mentioned above, and synthetic pulp paper, mixed paper of natural pulp and synthetic pulp, and various types of combined paper.

The thickness of the base paper is generally from 50 to 300 μm, preferably from 100 to 250 μm.

A water content of the base paper is appropriately in a range from 4 to 6%, preferably in a range from 4.5 to 5.5%. A too high water content is not preferred, because such a content can produce a high heat-shrinkage in the CD direction. A too low water content is also not preferred, because such a content can degrade the toner transfer properties.

Preferred examples of the base paper include wood free paper and paper described in "Shashin Kogaku no Kiso-Ginen Shashin Hen-(Fundamentals of Photographic Engineering-Edition of Silver Salt Photos-," edited by Nippon Shashin Gakkai and published by Corona Co., Ltd., pp.223–240, 1979.

Coated Paper

The coated paper may comprise a sheet of base paper and a coating that is formed on one or both sides of the sheet and made of kaolin, a pigment such as calcium carbonate, any resin, any rubber latex, or any polymer material in any amount depending on the use. Examples of such coated paper include coated paper, art paper, cast-coated paper, and the like. The coating layers formed on the front side and the backside, respectively, may be the same or different in component, physical properties, thickness, or composition.

For example, the uppermost coating layer of the coated paper may be made of a pigment and an aqueous binder. Examples of such a pigment include a mineral pigment such as precipitated calcium carbonate heavy, precipitated calcium carbonate light, kaolin, calcined kaolin, structural kaolin, delamikaolin, talc, calcium sulfate, barium sulfate, silica, magnesium aluminosilicate, fine-grain calcium silicate, fine-grain magnesium carbonate, fine-grain precipitated calcium carbonate light, white carbon, bentonite, zeolite, selicite, and smectites; and an organic pigment such as a polystyrene resin, a styrene-acryl copolymer resin, a urea resin, a melamine resin, an acrylic resin, a vinylidene chloride resin, a benzoguanamine resin, and fine hollow particles or through-hole type of these resins. One of these materials may be used alone, or two or more of these materials may be used in combination.

The binder for the pigment coating layer may be a water-soluble and/or water-dispersible high molecular compound. Examples of such a binder include starches such as cationic starch, amphoteric starch, oxidized starch, enzyme-modified starch, thermochemically modified starch, esterified starch, and etherified starch; cellulose derivatives such as carboxymethyl cellulose, hydroxyethyl cellulose, and methyl cellulose; natural or semi-synthetic high molecular compounds such as gelatin, casein, soy bean protein, and a natural rubber; polyvinyl alcohol; polydienes such as isoprene, neoprene and polybutadiene; polyalkenes such as polybutene, polyisobutyrene, polypropylene, and polyethylene; vinyl-base polymers or copolymers of vinyl halide, vinyl acetate, styrene, (meth)acrylic acid, (meth)acrylate ester, (meth)acrylamide, methyl vinyl ether, or the like; a synthetic rubber latex such as a styrene-butadiene latex and a methyl methacrylate-butadiene latex; and a synthetic polymer compound such as a polyurethane resin, a polyester resin, a polyamide resin, an olefin-maleic anhydride resin, and a melamine resin. One or more of these materials are appropriately selected and used depending on the desired quality of the electrophotographic transfer sheet.

To 100 parts by mass of the pigment, the binder is preferably added in an amount of 5 to 50 parts by mass, more preferably 7 to 30 parts by mass. If desired, any auxiliary agent for use with general coated paper pigments may also be used, such as a dispersing agent, a thickener, a water-holding agent, an anti-forming agent, a water resistant additive, waxes, a sizing agent, a fluorescent brightening agent, and a colorant.

The resulting coating composition may be applied using any general coating device such as a blade coater, an air knife coater, a roll coater, a bar coater, a curtain coater, a die coater, a gravure coater, a reverse roll coater, a champlex coater, and a brush coater.

The coating amount of the coating liquid is appropriately selected and set depending on the use of the electrophotographic transfer sheet. In order to increase the smoothness of the toner image-receiving layer, it is necessary to sufficiently cover the space between the fibrous materials or the fibers with a sufficient amount of the coating liquid. In general, therefore, the coating amount is appropriately 10 to 20 g/m$^2$ by dry weight per one side.

Laminated Paper

The laminated paper may comprise a base paper sheet and a sheet, film or the like of any resin, rubber or polymer, with which the base paper sheet is laminated. Examples of such a laminating material include polyolefin, polyvinyl chloride, polyethylene terephthalate, polystyrene, polymethacrylate, polycarbonate, polyimide, and triacetyl cellulose. One of these materials may be used alone, or two or more of these materials may be used in combination.

Many polyolefins are generally composed of low density polyethylene. In order to increase a heat resistance of the support, however, it is preferred to use polypropylene, a blend of polypropylene and polyethylene, high density polyethylene, a blend of high density polyethylene and low density polyethylene, or the like. The blend of high density polyethylene and low density polyethylene is most preferred in terms of cost and suitability for lamination.

For example, the high density polyethylene and the low density polyethylene is blended in a mass ratio of 1/9 to 9/1. The blending ratio is preferably from 2/8 to 8/2, more preferably from 3/7 to 7/3. When a thermoplastic resin layer is formed on both sides of the support, for example, the backside layer is preferably made of high density polyethylene or a blend of high density polyethylene and low density polyethylene. The polyethylene may have any molecular weight. In a preferred mode, any of the high density polyethylene and the low density polyethylene has a melt index of from 1.0 to 40 g/10 minutes and has suitability for extrusion.

The sheet may also be treated so as to have white reflective properties. For example, such a treatment is performed by adding a pigment such as titanium oxide to the sheet.

The laminating layer desirably has a thickness of 10 to 50 μm, preferably 20 to 40 μm for each side. If the laminating layer is too thin, the irregularity of the base paper can have a considerable influence so that the uniformity of the gloss can be reduced. If too thin, the heat shrinkage in the CD direction may not be reduced so that the adhesion to the fixing belt can be reduced and that the uniformity of the gloss can also be reduced. If the laminating layer is too thick, the toner transfer properties can be degraded.

The support may be a laminate of any combination of the above support materials.

A preferred method of coating the base paper with a resin or the like includes the step of coating, impregnating or spraying the base paper with a resin solution or suspension. For the purpose of increasing the adhesion of the base paper to the resin to be applied, one or both surfaces of the base paper are preferably subjected to an activation process such as corona discharge treatment, flame treatment, glow discharge treatment, or plasma treatment, before coated or laminated with the resin.

For the purpose of increasing the adhesion of the base paper or the coating or laminating layer formed thereon to the additional layer such as the toner image-receiving layer, the base paper or the coating or laminating layer may be subjected to a surface treatment such as corona discharge treatment or may be coated with an undercoat layer.

The support preferably has a thickness of 70 μm to 400 μm, more preferably 120 μm to 310 μm. The support may have any stiffness depending on the purpose. For example, the support for use in an electrophotographic image-receiving sheet of photographic quality preferably has a stiffness close to that of the support for use in silver-salt color photos.

In terms of fixing performance, the support preferably has a thermal conductivity of at least 0.50 kcal/m·h·° C. under normal conditions of 20° C. and a relative humidity of 65%. The thermal conductivity may be measured by a process including the steps of performing moisture-conditioning of the transfer paper under the above normal conditions and performing the measurement by the method described in JP-A No. 53-66279. From the above point of view, the support preferably has a density of 0.7 g/cm$^3$ or more.

As long as the effect of the invention is not ruined, the support may contain any appropriate type of additive such as a brightening agent, a conductive agent, a filler, and a pigment or dye such as titanium oxide, an ultramarine blue pigment and carbon black.

A hydrophilic binder and a semiconductive metal oxide such as alumina sol and tin oxide or any other antistatic agent such as carbon black may be added or applied to the support or the front surface and/or the back surface thereof. Specifically, the support disclosed in JP-A No. 63-220246 may be used. It is preferred that the support can withstand the fixing temperature and can satisfy the requirements for whiteness degree, smoothness, frictional properties, antistatic properties, depression after fixing, or the like.

Toner Image-Receiving Layer

The toner image-receiving layer is used for receiving a color or black toner and forming an image. The toner image-receiving layer has the function of: accepting the toner for forming the image from a development drum or an intermediate transfer element under (static) electricity, pressure or the like; and fixing the toner by heat, pressure or the like in the fixing process.

In order to create a photorealistic feeling on the inventive electrophotographic recording sheet, the toner image-receiving layer should have low transparency and therefore a light transmittance of 78% or less, preferably 73% or less, more preferably 72% or less.

The light transmittance may be determined by a process including the steps of forming such a coating film with the same thickness on a separately prepared polyethylene terephthalate film (100 μm) and performing the measurement on the coating film using a direct-reading haze meter (HGM-2DP (trade name) manufactured by Suga Test Instrument Co., Ltd.).

The material for the toner image-receiving layer may be in the first or second mode as shown below. In the first mode, the toner image-receiving layer contains a thermoplastic resin and a natural wax and optionally any other component. In the second mode, the toner image-receiving layer contains a thermoplastic resin and a release agent with a melting point of 70 to 95° C. and optionally any other component.

Thermoplastic Resin

Any thermoplastic resin that can deform at the fixing temperature and accept the toner may be appropriately selected and used depending on the purpose. The thermoplastic resin is preferably the same type as that of the binder resin in the toner. Many types of toners contain a polyester resin, styrene or a styrene-butyl acrylate copolymer resin. In such cases, therefore, the thermoplastic resin used in the electrophotographic image-receiving sheet preferably comprises a polyester resin, styrene or a copolymer resin such as a styrene-butyl acrylate copolymer, more preferably in an amount of 20% by mass or more. The thermoplastic resin also preferably comprises styrene, a styrene-butyl acrylate copolymer, a styrene-acrylate ester copolymer, a styrene-methacrylate ester copolymer, or the like.

Examples of the thermoplastic resin include an ester bond-containing resin, a polyurethane resin, a polyamide resin, a polysulfone resin, a polyvinyl chloride resin, polyvinyl butyral, a polycaprolactone resin, and a polyolefin resin.

Examples of the ester bond-containing resin include a polyester resin produced by the condensation of a dicarboxylic acid component: such as terephthalic acid, isophthalic acid, maleic acid, fumaric acid, phthalic acid, adipic acid, sebacic acid, azelaic acid, abietic acid, succinic acid, trimellitic acid, and pyromellitic acid (any of these dicarboxylic acid components may have a substituent such as a sulfonic acid group and a carboxyl group); with an alcohol component: such as ethylene glycol, diethylene glycol, propylene glycol, bisphenol A, a diether derivative of bisphenol A (such as a bis-ethylene oxide adduct of bisphenol A and a bis-propylene oxide adduct of bisphenol A), bisphenol S, 2-ethylcyclohexyl dimethanol, neopentyl glycol, cyclohexyl dimethanol, and glycerol (any of these alcohol components may have a substituent such as a hydroxyl group); a polyacrylate resin or a polymethacrylate resin such as poly(methyl methacrylate), poly(butyl methacrylate), poly(methyl acrylate), and poly(butyl acrylate); a polycarbonate resin, a polyvinyl acetate resin, a styrene-acrylate resin, a styrene-methacrylate ester copolymer resin, and a vinyl toluene-acrylate resin. Specific examples thereof include those disclosed in JP-A Nos. 59-101395, 63-7971, 63-7972, 63-7973, and 60-294862.

Commercially available products of the polyester resin include Bylon 290, Bylon 200, Bylon 280, Bylon 300, Bylon 103, Bylon GK-140, and Bylon GK-130 each manufactured by Toyobo Co., Ltd.; Tufton NE-382, Tufton U-5, ATR-2009, and ATR-2010 each manufactured by Kao Corporation; Eritel UE3500, UE3210 and XA-8153 each manufactured by Unitika Ltd.; and Polyester TP-220 and R-188 each manufactured by The Nippon Synthetic Chemical Industry Co., Ltd. (all trade names).

Commercially available products of the acrylic resin include Dianal SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, and BR-117 each manufactured by Mitsubishi Rayon Co., Ltd.; Esrec PSE-0020, SE-0040, SE-0070, SE-0100, SE-1010, and SE-1035 each manufactured by Sekisui Chemical Co., Ltd.; Himer ST95 and ST120 from Sanyo Chemical Industries, Ltd.; and FM601 manufactured by Mitsui Chemicals, Inc. (all trade names).

Examples of the polyvinyl chloride resin include a polyvinylidene chloride resin, a vinyl chloride-vinyl acetate copolymer resin, and a vinyl chloride-vinyl propionate copolymer resin.

Examples of the polyvinyl butyral include a polyol resin and a cellulose resin such as an ethyl cellulose resin and a cellulose acetate resin. For example, commercially available products thereof are manufactured by Denki Kagaku Kogyo Kabushiki Kaisha or Sekisui Chemicals Ltd. The polyvinyl butyral product preferably contains 70% by mass or more of polyvinyl butyral and preferably has an average polymerization degree of 500 or more, more preferably 1000 or more. Examples of the commercially available products thereof include Denka Butyral 3000-1, 4000-2, 5000A, and 6000C each manufactured by Denki Kagaku Kogyo Kabushiki Kaisha; and Esrec BL-1, BL-2, BL-3, BL-S, BX-L, BM-1, BM-2, BM-5, BM-S, BH-3, BX-1, and BX-7 each manufactured by Sekisui Chemicals Ltd. (all trade names).

Examples of the polycaprolactone resin include a styrene-maleic anhydride resin, a polyacrylonitrile resin, a polyether resin, an epoxy resin, and a phenol resin.

Examples of the polyolefin resin include a polyethylene resin and a polypropylene resin, and a copolymer resin of an olefin such as ethylene and propylene and any other vinyl monomer; and an acrylic resin.

One of these thermoplastic resins may be used alone, or two or more of these thermoplastic resins may be used in combination. Any mixture thereof or any copolymer thereof may also be used.

In a preferred manner, the thermoplastic resin can form a toner image-receiving layer that fulfills the physical properties as described blow. A single resin that can satisfy the above physical properties of the toner image-receiving layer may preferably be used. Alternatively, two or more resins that can provide different physical properties for the toner image-receiving layer may also preferably be used.

The thermoplastic resin may preferably have a higher molecular weight than that of the thermoplastic resin in the toner. However, this relationship for the molecular weight is not always preferred depending on the relationship between the thermodynamic properties of the toner resin and the toner image-receiving layer resin. For example, if the thermoplastic resin of the toner image-receiving layer has a higher softening temperature than that of the toner resin, it can sometimes be preferred that the molecular weight of the toner image-receiving layer resin is the same as or lower than that of the toner resin.

A mixture of thermoplastic resins, which are the same in constituent but different in average molecular weight, is also preferably used. A preferred relationship with the molecular weight of the thermoplastic toner resin is disclosed in JP-A No. 08-334915.

The distribution of the molecular weight of the thermoplastic resin is preferably wider than that of the thermoplastic toner resin.

The thermoplastic resin preferably satisfies the physical properties as disclosed in JP-B No. 05-127413, and JP-A Nos. 08-194394, 08-334915, 08-334916, 09-171265, and 10-221877.

In particular, the toner image-receiving layer preferably contains an aqueous resin such as a water-soluble or water-dispersible resin as the thermoplastic resin, for the following reasons:

(i) no organic solvent is discharged from the application process or the drying process, so that good environmental or working suitability can be provided;

(ii) many types of release agents such as waxes are hardly soluble in a solvent at room temperature and therefore are often dispersed in the solvent (water or an organic solvent) before use. An aqueous dispersion is more stable and has better suitability for the manufacturing process. Aqueous application can more easily cause bleeding of the wax on the surface through the application and drying process, so that the effect of the release agent (such as anti-offset properties and adhesion resistance) can easily be achieved.

Any aqueous resin that is water-soluble or water-dispersible may be used without limitation upon composition, bond structure, molecular structure, molecular weight, distribution of molecular weight, or conformation. Examples of the aqueous property-developing group of the polymer include a sulfonic acid group, a hydroxyl group, a carboxylic acid group, an amino group, an amide group, and an ether group. Examples of the water-soluble resin are described in Research Disclosure No. 17, Vol. 643, 26, Research Disclosure No. 18, Vol. 716, 651, Research Disclosure No. 307, Vol. 105, 873-873, and JP-A No. 64-13546, pp.71–75.

Specific examples thereof include a vinyl pyrrolidone-vinyl acetate copolymer, a styrene-vinyl pyrrolidone copolymer, a styrene-maleic anhydride copolymer, a water-soluble polyester resin, a water-soluble acrylic resin, a water-soluble polyurethane resin, water-soluble nylon, and a water-soluble epoxy resin. Any gelatin or any combination of gelatins may be selected from liming gelatin, acid-treated gelatin, and so-called deliming gelatin, which has a reduced content of calcium and the like.

Examples of the commercially available product include various types of Plus Coat manufactured by GaO Chemical Industries and FineTex ES series manufactured by Dainippon Ink and Chemicals, Incorporated as the water-soluble polyester; Julimer AT series manufactured by Nihon Junyaku CO., LTD., FineTex 6161 and K-96 manufactured by Dainippon Ink and Chemicals, Incorporated, and Hiros NL-1189 and BH-997L manufactured by SEIKO PMC CORPORATION as the water-soluble acrylic resin (all trade names).

Examples of the water dispersed resin include a water dispersion type resin such as a water dispersion of acrylic resin, a water dispersion of polyester resin, a water dispersion of polystyrene resin, and a water dispersion of urethane resin; an emulsion such as an acrylic resin emulsion, a polyvinyl acetate emulsion, and an SBR (styrene-butadiene rubber) emulsion; and a water dispersion or emulsion of any of the above thermoplastic resins. Two or more materials may appropriately be selected from these copolymers, mixtures thereof and cation-modified materials thereof and may be used in combination.

Examples of the commercially available water-dispersed resin include Byronal Series manufactured by Toyobo Co., Ltd., Pethregin A Series manufactured by Takamatsu Oil & Fat CO., Ltd., Tufton UE Series manufactured by Kao Corporation, Polyester WR Series manufactured by The Nippon Synthetic, and Aeriel Series manufactured by Unitika Ltd. (each based on polyester); and Hiros XE, KE and PE series manufactured by SEIKO PMC CORPORATION and Julimer ET series manufactured by Nihon Junyaku CO., Ltd. (each based on acrylic resin). The film-forming temperature (MFT) of the polymer is preferably room temperature or higher in terms of the storage before printing and preferably 100° C. or lower in terms of the fixation of toner particles.

The thermoplastic resin is preferably used in the form of an aqueous self-dispersing polyester resin emulsion that satisfies the characteristics (1) to (4) below. Such a self-dispersing resin emulsion is free of any surfactant and therefore have low hygroscopicity even in a high-humidity atmosphere. The softening point of such a resin is less lowered by water. Therefore, offset can be prevented in the fixing process, and a sticking accident between the sheets can also be prevented during storage. Such an aqueous material is also good in terms of environmental properties and workability. The polyester in such an emulsion can easily have a high cohesive energy molecular structure. Therefore, the polyester, which has sufficient hardness in a storage environment, can have a molten state with low elasticity (low viscosity) in the electrophotographic fixing process, so that the toner can be sufficiently embedded into the toner image-receiving layer and therefore can form a sufficiently high quality image.

(1) The number average molecular weight (Mn) is preferably from 5000 to 10000, more preferably from 5000 to 7000;

(2) The distribution of the molecular weight (weight average molecular weight/number average molecular weight) (Mw/Mn) is preferably 4 or less, more preferably 3 or less;

(3) The glass transition temperature (Tg) is preferably from 40 to 100° C., more preferably from 50 to 80° C.;

(4) The volume average particle diameter is preferably from 20 to 200 nm, more preferably from 40 to 150 nm.

Natural Wax

In the invention, the toner image-receiving layer preferably contains natural wax as a release agent. It is because if natural wax is used, the resulting electrophotographic image-receiving sheet can have good anti-offset properties, good adhesion resistance, good transferability, and good gloss, can resist cracking, and can form a high quality image. The natural wax is preferably at least one of vegetable wax and mineral wax. Vegetable wax is particularly preferred. The natural wax is preferably in the form of a water dispersion, in terms of compatibility with the aqueous thermoplastic resin in the toner image-receiving layer.

Examples of the vegetable wax include carnauba wax (commercially available as: EMUSTAR AR-0413 (trade name) manufactured by Nippon Seiro Co., Ltd. and Cellusol 524 (trade name) manufactured by Chukyo Yushi Co., Ltd.), castor oil (commercially available as: purified castor oil manufactured by Itoh Oil Chemicals Co., Ltd.), rapeseed oil, soybean oil, Japan tallow, cotton wax, rice wax, sugarcane wax, candellila wax, Japan wax, and jojoba oil. Examples of the animal wax include beeswax, lanolin, spermaceti, whale oil, and wool wax. In particular, carnauba wax with a melting point of 70 to 95° C. is preferred. It is because if such wax is used, the resulting electrophotographic recording sheet can have good anti-offset properties, good adhesion resistance, good transferability, and good gloss, can resist cracking, and can form a high quality image.

Examples of the mineral wax include natural wax such as montan wax, montan ester wax, ozokerite, and ceresin; a fatty acid ester (commercially available as: Sansosizer-DOA, AN-800, DINA, DIDA, DOZ, DOS, TOTM, TITM, E-PS, nE-PS, E-PO, E-4030, E-6000, E-2000H, E-9000H, TCP, and C-1100 (all trade names, manufactured by New Japan Chemical Co., Ltd.); and synthetic hydrocarbon wax such as polyethylene wax (commercially available as: polyron A, 393, and H-481 manufactured by Chukyo Yushi Co., Ltd.; and Sunwax E-310, E-330, E-250P, LEL-250, LEL-800, and LEL-400 (all trade names) each manufactured by Sanyo Chemical Industries, Ltd.) and polypropyrene wax (commercially available as: Biscoal 330-P, 550-P and 660-P (all trade names) each manufactured by Sanyo Chemical Industries, Ltd.). In particular, montan wax with a melting point of 70 to 95° C. is preferred. It is because if such wax is used, the resulting electrophotographic recording sheet can have good anti-offset properties, good adhesion resistance, good transferability, and good gloss, can resist cracking, and can form a high quality image.

The content ($g/m^2$) of the natural wax in the toner receiving layer (front side) is preferably from 0.1 to 4 $g/m^2$, more preferably 0.2 to 2 $g/m^2$. If the content is less than 0.1 $g/m^2$, the anti-offset properties or the adhesion resistance can be insufficient. If more than 4 $g/m^2$, such an excessive amount of the wax can reduce the quality of the formed image.

The melting point (° C.) of the natural wax is preferably from 70 to 95° C., more preferably from 75 to 90° C., in terms of anti-offset properties and transferability.

Release Agent

The release agent is added to the toner image-receiving layer, in order to prevent offset of the toner image-receiving layer. The inventive method may use any type of release agent that can be thermally fused at the fixing temperature, can precipitate and segregate on the surface of the toner image-receiving layer, and can form a release agent layer on the surface of the toner image-receiving layer through cooling and solidification. For example, the release agent with such an effect and a function is at least one selected from the group consisting of a silicone compound, a fluorine compound, wax, and a matting agent. Preferably, the release agent is at least one selected from the group consisting of silicone oil, polyethylene wax, carnauva wax, silicone particles, and polyethylene wax particles.

Examples of the release agent for use in the invention include the compounds disclosed in "Properties and Applications of Wax (Revised)" published by Saiwai Shobo; the compounds disclosed in "The Silicone Handbook" published by The Nikkan Kogyo Shimbun, Ltd.; preferably the silicone compounds, the fluorine compounds and the wax (exclusive of natural wax) contained in the toners disclosed in JP-B Nos. 59-38581, 04-32380, Japanese Patent (JP) Nos. 2838498 and 2949558, and JP-A Nos. 50-117433, 52-52640, 57-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049, and 11-194542. Two or more of these compounds may be used in combination.

Examples of the silicone compound include non-modified silicone oil (such as dimethyl siloxane oil, methyl hydrogen silicone oil, phenyl methyl silicone oil, and commercially available products such as KF-96, KF-96L, KF-96H, KF-99, KF-50, KF-54, KF-56, KF-965, KF-968, KF-994, KF-995 and HIVAC F-4 and F-5 each manufactured by Shin-Etsu Chemical. Co., Ltd.; SH200, SH203, SH490, SH510, SH550, SH710, SH704, SH705, SH7028A, SH7036, SM7060, SM7001, SM7706, SH7036, SH8710, SH1107, and SH8627 each manufactured by Dow Corning Toray Silicone Co., Ltd.; and TSF400, TSF401, TSF404, TSF405, TSF431, TSF433, TSF434, TSF437, TSF450 Series, TSF451 Series, TSF456, TSF458 Series, TSF483, TSF484, TSF4045, TSF4300, TSF4600, YF33 Series, YF-3057, YF-3800, YF-3802, YF-3804, YF-3807, YF-3897, XF-3905, XS69-A1753, TEX100, TEX101, TEX102, TEX103, TEX104, and TSW831 each manufactured by GE Toshiba Silicones) (all trade names); amino-modified silicone oil (commercially available as: KF-857, KF-858, KF-859, KF-861, KF-864, and KF-880 each manufactured by Shin-Etsu Chemical Co., Ltd.; SF8417 and SM8709 each manufactured by Dow Corning Toray Silicone Co., Ltd.; and TSF4700, TSF4701, TSF4702, TSF4703, TSF4704, TSF4705, TSF4706, TEX150, TEX151, and TEX154 each manufactured by GE Toshiba Silicones (all trade names)); carboxy-modified silicone oil (commercially available as: BY16-880 manufactured by Dow Corning Toray Silicone Co., Ltd. and TSF4770 and XF42-A9248 each manufactured by GE Toshiba Silicones (all trade names)); carbinol-modified silicone oil (commercially available as: XF42-B0970 (trade name) manufactured by GE Toshiba Silicones); vinyl-modified silicone oil (commercially available as: XF40-A1987 (trade name) manufactured by GE Toshiba Silicones); epoxy-modified silicone oil (commercially available as: SF8411 and SF8413 each manufactured by Dow Corning Toray Silicone Co., Ltd. and TSF3965, TSF4730, TSF4732, XF42-A4439, XF42-A4438, XF42-A5041, XC96-A4462, XC96-A4463, XC96-A4464, and TEX170 (all trade names) each manufactured by GE Toshiba Silicones); polyether-modified silicone oil (commercially available as: KF-351 (A), KF-352(A), KF-353(A), KF-354(A), KF-355(A), KF-615(A), KF-618, and KF-945(A) each manufactured by Shin-Etsu Chemical Co., Ltd., SH3746, SH3771, SF8421, SF8419, SH8400, and SF8410 each manufactured by Dow Corning Toray Silicone Co., Ltd. and TSF4440, TSF4441, TSF4445, TSF4446, TSF4450, TSF4452, TSF4453, and TSF4460 each manufactured by GE Toshiba Silicones (all trade names)); silanol-modified silicone oil; methacryl-modified silicone oil; mercapto-modified silicone oil; alcohol-modified silicone oil (commercially available as: SF8427 and SF8428 manufactured by Dow Corning Toray Silicone Co., Ltd. and TSF4750, TSF4751 and XF42-B0970 each manufactured by GE Toshiba Silicones (all trade names)); alkyl-modified silicone oil (commercially available as: SF8416 manufactured by Dow Corning Toray Silicone Co., Ltd. and TSF410, TSF411, TSF4420, TSF4421, TSF4422, TSF4450, XF42-334, XF42-A3160, and XF42-A3161 each manufactured by GE Toshiba Silicones (all trade names)); fluorine-modified silicone oil (commercially available as: FS1265 manufactured by Dow Corning Toray Silicone Co., Ltd. and FQF501 manufactured by GE Toshiba Silicones (all trade names)); silicone rubber and silicone fine particles (commercially available as: SH851, SH745U, SH55UA, SE4705U, SH502 UA&B, SRX539U, SE6770U-P, DY38-038, DY38-047, Trefil F-201, F-202, F-250, R-900, R-902A, E-500, E-600, E-601, E-506, and BY29-119 each manufactured by Dow Corning Toray Silicone Co., Ltd. and Tospal 105, 120, 130, 145, 240, and 3120 each manufactured by GE Toshiba Silicones (all trade names)); a silicone-modified resin (such as silicone-modified compounds of olefin resin, polyester resin, vinyl resin, polyamide resin, cellulose resin, phenoxy resin, vinyl chloride-vinyl acetate resin, urethane resin, acrylic resin, styrene-acrylic resin, or a copolymer resin thereof, and commercially available products such as Diaroma SP203V, SP712, SP2105, and SP3023 each manufactured by Dainichiseika Color & Chemicals Mfg. Co., Ltd., Modepa FS700, FS710, FS720, FS730, and FS770 each manufactured by Nippon Oil & Fats Co., Ltd., Simac US-270, US-350, US-352, US-380, US-413, and US-450, Reseda GP-705, GS-30, GF-150, and GF-300 each manufactured by Toagosei Co., Ltd., SH997, SR2114, SH2104, SR2115, SR2202, DCI-2577, SR2317, SE4001U, SRX625B, SRX643, SRX439U, SRX488U, SH804, SH840, SR2107, and SR2115 each manufactured by Dow Corning Toray Silicone Co., Ltd., YR3370, TSR1122, TSR102, TSR108, TSR116, TSR117, TSR125A, TSR127B, TSR144, TSR18O, TSR187, YR47, YR3187, YR3224, YR3232, YR3270, YR3286, YR3340, YR3365, TEX152, TEX153, TEX171, and TEX172 each manufactured by GE Toshiba Silicones (all trade names)); and reactive silicone compounds (such as an addition reaction type, a peroxide-curable type, an ultraviolet radiation curable type, and commercially available products such as TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A 2982, XS56-A3075, XS56-A3969, XS56-A5730, XS56-A8012, XS56-B1794, SL6100, SM3000, SM3030, SM3200, and YSR3022 each manufactured by GE Toshiba Silicones (all trade names)).

Examples of the fluorine compounds include fluorine oil (commercially available as: Daifluoryl #1, #3, #10, #20, #50, and #100, Unidyne TG-440, TG-452, TG490, TG-560, TG-561, TG-590, TG-652, TG-670U, TG-991, TG-999, TG-3010, TG-3020, and TG-3510 each manufactured by Daikin Industries, Ltd., MF-100, MF-110, MF-120, MF-130, MF-160, and MF-160E each manufactured by Tohkem Products Corporation, S-111, S-112, S-113, S-121, S-131, S-132, S-141, and S-145 each manufactured by Asahi Glass Company, and FC-430 and FC-431 manufactured by Du Pont-Mitsui Fluorochemicals Company, Ltd. (all trade names)); fluoro-rubber (commercially available as: LS63U (trade name) manufactured by Dow Corning Toray Silicone Co., Ltd.); fluorine-modified resins (commercially available as: Modepa F200, F220, F600, F2020, and F3035 each manufactured by Nippon Oil & Fats Co., Ltd., Diaroma FF203 and FF204 manufactured by Dainichseika Color & Chemicals Mfg. Co., Ltd., Saflon S-381, S-383, S-393, SC-101, SC-105, KH-40, and SA-100 each manufactured by Asahi Glass Company, EF-351, EF-352, EF-801, EF-802, EF-601, TFE, TFEA, TFEMA, and PDFOH each manufactured by Tohkem Products Corporation, and THV-200P manufactured by Sumitomo 3M (all trade names)); fluorosulfonic acid compounds (commercially available as: EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS, and LFBS each manufactured by Tohkem Products Corporation (all trade names)); fluorosulfonic acid and fluorine acid compounds or salts such as anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, and ammonium perfluorooctanoate; and inorganic fluorides (such as aluminum fluoride, potassium fluoride, fluoro-potassium zirconate, zinc fluoride tetrahydrate, calcium fluoride, lithium fluoride, barium fluoride, tin fluoride, potassium fluoride, acid potassium fluoride, magnesium fluoride, fluoro-titanic acid, fluorozirconic acid, ammonium hexafluorophosphate, and potassium hexafluorophosphate).

Examples of the wax include petroleum wax such as paraffin wax (commercially available as: Paraffin wax 155, 150, 140, 135, 130, 125, 120, 115, HNP-3, HNP-5, HNP-9, HNP-10, HNP-1, HNP-12, HNP-14G, SP-0160, SP-0145, SP-1040, SP-1035, SP-3040, SP-3035, NPS-8070, NPS-L-70, OX-2151, OX-2151, E-MUSTAR-0384, and E-MUSTAR-0136 each manufactured by Nippon Seiro Co., Ltd.; Cellosol 686, 428, 651-A, A, H-803, B-460, E-172, 866, and K-133, Hydrin D-337 and E-139 each manufactured by Chukyo Yushi Co., Ltd.; and 125° paraffin, 125° FD, 130° paraffin, 135° paraffin, 1350 H, 140° paraffin, 140° N, 145° paraffin, and paraffin wax M each manufactured by Nippon Oil Corporation (all trade names)).

Examples of the wax also include microcrystalline wax (commercially available as: Hi-Mic-2095, Hi-Mic-3090, Hi-Mic-1080, Hi-Mic-1070, Hi-Mic-2065, Hi-Mic-1045, Hi-Mio-2045, EMUSTAR-0001, and EMUSTAR-042X each manufactured by Nippon Seiro Co., Ltd.; Cellosol 967 and M manufactured by Chukyo Yushi Co., Ltd.; 155 Microwax and 180 Microwax manufactured by Nippon Oil Corporation (all trade names)); and petrolatum (commercially available as: OX-1749, OX-0450, OX-0650B, OX-0153, OX-261BN, OX-0851, OX-0550, OX-0750B, JP-1500, JP-056R, and JP-011P each manufactured by Nippon Seiro Co., Ltd. (all trade names)).

Examples of the wax also include Fischer-Tropsch wax (commercially available as: FT100 and FT-0070 manufactured by Nippon Seiro Co., Ltd. (all trade names)); acid amide compounds or acid imide compounds (such as stearic acid amide, phthalic anhydride imide, and commercially available products such as Cellusol 920, B-495, Hymicron G-270, G-110, and Hydrine D-757 (all trade names) each manufactured by Chukyo Yushi Co., Ltd.); modified wax such as amine-modified polypropyrene (commercially available as: QN-7700 (trade name) manufactured by Sanyo Chemical Industries, Ltd.); acrylic acid-modified wax; fluorine-modified wax; olefin-modified wax; urethan wax (commercially available as: NPS-6010 and HAD-5090 manufactured by Nippon Seiro Co., Ltd. (all trade names)); and alcohol type wax (commercially available as: NPS-9210, NPS-9215, OX-1949, and XO-020T each manufactured by Nippon Seiro Co., Ltd.(all trade names)).

Examples of synthetic wax include hydrogenated wax such as cured castor oil (commercially available as: Castor Wax (trade name) manufactured by Itoh Oil Chemicals Co., Ltd.); castor oil derivatives (commercially available as: dehydrated castor oil DCO, DCOZ-1, and DCOZ-3, castor oil fatty acid CO-FA, ricinoleic acid, dehydrated castor oil fatty acid DCO-FA, dehydrated castor oil fatty acid epoxy ester D-4 ester, castor oil-based urethane acrylate CA-10, CA-20, CA-30, castor oil derivative MINERASOL S-74, S-80, S-203, S-42X, and S-321, special castor oil-based condensed fatty acid MINERASOL RC-2, RC-17, RC-55, and RC-335, special castor oil-based condensed fatty acid ester MINERASOL LB-601, LB-603, LB-604, LB-702, LB-703, #11, and L-164 (all trade names) each manufactured by Itoh Oil Chemicals Co., Ltd.); stearic acid (commercially available as: 12-hydroxystearic acid manufactured by Itoh Oil Chemicals Co., Ltd.); lauric acid, myristic acid, palmitic acid, behenic acid, sebacic acid (commercially available as: sebacic acid manufactured by Itoh Oil Chemicals Co., Ltd.), undecylenic acid (commercially available as: undecylenic acid manufactured by Itoh Oil Chemicals Co., Ltd.), heptyl acid (commercially available as: heptyl acid manufactured by Itoh Oil Chemicals Co., Ltd.), maleic acid, high-grade maleic oil (commercially available as: HIMALEIN DC-15, LN-10, 00-15, DF-20, and SF-20 (all trade names) each manufactured by Itoh Oil Chemicals Co., Ltd.), blown oil (commercially available as: Selbonol #10, #30, #60, R-40, and S-7 (all trade names) each manufactured by Itoh Oil Chemicals Co., Ltd.), and cyclopentadieneic oil (commercially available as: CP oil and CP oil-S (all trade names) manufactured by Itoh Oil Chemicals Co., Ltd.).

Various types of matting agents are known. Solid particles used as the matting agent can be classified into inorganic particles and organic particles. Examples of the material for the inorganic matting agent include oxides such as silicon dioxide, titanium oxide, magnesium oxide, and aluminum oxide, alkaline earth metal salts such as barium sulfate, calcium carbonate, and magnesium sulfate, silver halides such as silver chloride and silver bromide, and glass.

Examples of the inorganic matting agent also include those disclosed in West German Patent No. 2529321, U.K. Patent Nos. 7-60775 and 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245, and 4,029,504.

Examples of the material for the organic matting agent include starch, cellulose ester such as cellulose acetate propionate, cellulose ether such as ethyl cellulose, and a synthetic resin. The synthetic resin is preferably insoluble or hardly soluble in water. Examples of the synthetic resin insoluble or hardly soluble in water include poly(meta) acrylate such as polyalkyl(meta)acrylate, polyalkoxyalkyl (meta)acrylate and polyglycidyl(meta)acrylate, poly(meta) acrylamide, polyvinyl ester such as polyvinyl acetate, polyacrylonitrile, polyolefin such as polyethylene, polystyrene, a benzoguanamine resin, a formaldehyde condensed polymer, an epoxy resin, polyamide, polycarbonate, a phenol resin, polyvinyl carbazole, and polyvinylidene chloride.

Any copolymer composed of any combination of the monomers for the above polymers may also be used. Such a copolymer may contain a small amount of hydrophilic repeating units. Examples of the monomer for the repeating unit with the hydrophilicity include acrylic acid, methacrylic acid, $\alpha,\beta$-unsaturated dicarboxylic acid, hydroxyalkyl (meta)acrylate, sulfoalkyl (meta)acrylate, and styrene sulfonic acid.

Examples of the organic matting agent include those disclosed in U.K. Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924, and 3,767,448, and JP-A Nos. 49-106821 and 57-14835.

Two or more types of solid particles may be used in combination. The average particle size of the solid particles is typically 1 to 100 μm, preferably 4 to 30 μm. The solid particles may be used in an amount of 0.01 to 0.5 g/m$^2$, preferably 0.02 to 0.3 g/m$^2$.

The release agent added to the toner image-receiving layer may also be any derivative, oxide, refined product, or mixture of the above materials. Such a material may also have a reactive substituent.

The melting point (° C.) of the release agent is preferably from 70 to 95° C., more preferably 75 to 90° C., in terms of anti-offset properties and transportability.

A water dispersion type release agent is also preferred, particularly in terms of compatibility with the aqueous thermoplastic resin in the toner image-receiving layer.

The content of the release agent in the toner image-receiving layer is preferably from 0.1 to 10% by mass, more preferably from 0.3 to 8.0% by mass, still more preferably from 0.5 to 5.0% by mass. In the invention, the content of the release agent is defined as the total content of the release agent including the natural wax.

Colorant

Examples of the colorant include a fluorescent brightening agent, a white pigment, a colored pigment, and a dye. Any known fluorescent brightening agent may be used, which has absorption in the near-ultraviolet region and generates fluorescence in the range from 400 to 500 nm. Preferred examples of the fluorescent brightening agent include the compounds described in "The Chemistry of Synthetic Dyes" Volume V, Chapter 8, edited by K. Veen-Rataraman. Specific examples thereof include stilbene compounds, coumarin compounds, biphenyl compounds, benzoxazoline compounds, naphthalimide compounds, pyrazoline compounds, and carbostyryl compounds. Examples of such compounds include White Furfar PSN, PHR, HCS, PCS, and B manufactured by Sumitomo Chemicals, and UVITEX-OB manufactured by Ciba-Geigy (all trade names).

Examples of the white pigment include the inorganic pigments as stated in the above "filler" section (such as titanium oxide, calcium carbonate, and the like). Examples of the colored pigment include various types of pigments disclosed in JP-A No. 63-44653, azo pigments (such as azo lakes such as carmine 6B and red 2B, insoluble azo compounds such as monoazo yellow, disazo yellow, pyrazolone orange, Balkan orange, and condensed azo compounds such as chromophthal yellow and chromophthal red); polycyclic pigments (such as phthalocyanines such as copper phthalocyanine blue and copper phthalocyanine green); dioxadines such as dioxadine violet; isoindolinones such as isoindolinone yellow; surenes such as perylene, perinon, flavantrone, and thioindigo; lake pigments (such as malachite green, rhodamine B, rhodamine G, and Victoria blue B); and inorganic pigments (such as oxides such as titanium dioxide and red ocher, sulfates such as precipitated barium sulfate, carbonates such as precipitated calcium carbonate, silicates such as water-containing silicate and anhydrous silicate, metal powder such as aluminum powder, bronze powder, and zinc dust, carbon black, chrome yellow, and Berlin blue. One of these materials may be used alone, or two or more of these materials may be used in combination. Titanium oxide is particularly preferred as the pigment.

The pigment may be in any shape but preferably in the shape of hollow particles in terms of having advantageous heat conductivity (low heat conductivity) during the image fixing process.

Various types of known dyes may be used. Examples of oil-soluble dyes include anthraquinone compounds and azo compounds.

Examples of water-insoluble dyes include vat dyes such as C.I. Vat violet 1, C.I. Vat violet 2, C.I. Vat violet 9, C.I. Vat violet 13, C.I. Vat violet 21, C.I. Vat blue 1, C.I. Vat blue 3, C.I. Vat blue 4, C.I. Vat blue 6, C.I. Vat blue 14, C.I. Vat blue 20, and C.I. Vat blue 35; disperse dyes such as C.I. disperse violet 1, C.I. disperse violet 4, C.I. disperse violet 10, C.I. disperse blue 3, C.I. disperse blue 7, and C.I. disperse blue 58; and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25, and C.I. solvent blue 55.

Colored couplers for use in silver halide photography may also be preferably used.

The content ($g/m^2$) of the colorant in the toner image-receiving layer (front side) is preferably 0.1 to 8 $g/m^2$, more preferably 0.5 to 5 $g/m^2$.

If the content of colorant is less than 0.1 $g/m^2$, the light transmittance of the toner image-receiving layer can be high. If the content of the colorant is more than 8 $g/m^2$, handleability can be degraded due to cracking or low adhesive resistance.

In the toner image-receiving layer, the ratio of the colorant content ($g/m^2$) to the natural wax content ($g/m^2$) (colorant/natural wax) is preferably from 0.1/2 to 8/0.1, more preferably from 0.5/1.5 to 5/0.2. If the content ratio is less than the lower limit, the opacity of the electrophotographic image-receiving sheet can be insufficient. If more than the upper limit, the anti-offset properties can particularly be reduced.

Other Components

Examples of other components include various types of additives which may be added to improve the thermodynamic properties of the toner image-receiving layer, such as a plasticizer, a filler, a crosslinking agent, a charge control agent, an emulsifier, and a dispersing agent. The other components for use in the toner image-receiving layer is preferably in the shape of hollow particles, in terms of providing the toner image-receiving layer with advantageous heat conductivity (low heat conductivity) during the image fixing process. In particular, the pigment is preferably in the shape of hollow particles.

Plasticizer

Any plasticizer for use in any known resin may be used without limitation. The plasticizer has the function of controlling the fluidization or softening of the toner image-receiving layer under the heat and/or the pressure applied in the process of fixing the toner. The plasticizer may be selected with reference to "*Chemical Handbook*" (Chemical Institute of Japan, Maruzen), "*Plasticizers-their Theory and Application*", (ed. Kohichi Murai, Saiwai Shobo), "*The Study of Plasticizers, Part* 1" and "*The Study of Plasticizers, Part* 2" (Polymer Chemistry Association), or "*Handbook of Rubber and Plastics Blending Agents*" (ed. Rubber Digest Co.).

Although some plasticizers are listed as a high-boiling organic solvent, a hot solvent, or the like, examples of the plasticizer include esters (such as phthalate esters, phosphate esters, fatty acid esters, abietic acid esters, adipate esters, sebacate esters, azelate esters, benzoates, butylates, epoxy fatty acid esters, glycolate esters, propionate esters, trimellitate esters, citrates, sulfonates, carboxylates, succinate esters, maleates, fumarate esters, phthalate esters, and stearate esters), amides (such as fatty acid amides and sulfoamides), ethers, alcohols, lactones, and polyethyleneoxy compounds, disclosed in JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646, and 02-235694

The plasticizer may be mixed with the resin before use.

The plasticizer may be a polymer having relatively low molecular weight. In this case, the plasticizer preferably has a lower molecular weight than that of the binder resin to be plasticized and preferably has a molecular weight of 15000 or less, more preferably 5000 or less. A polymer plasticizer is preferably the same type as that of the binder resin to be plasticized. For example, low-molecular weight polyester is preferably used to plasticize the polyester resin. Any oligomer may also be used as the plasticizer.

Other examples of the plasticizer include commercially available products such as Adecasizer PN-170 and PN-1430 manufactured by Asahi Denka Kogyo K.K.; PARAPLEX-G-25, G-30 and G40 manufactured by C. P. Hall; and Ester gum 8L-JA, Ester R-95, Pentalin 4851, FK 115, 4820, and 830, Ruizol 28-JA, Picolastic A75, Picotex LC, and Cristalex 3085 (all trade names) each manufactured by Rika Hercules, Inc.

The plasticizer can be used as desired to relax stress or distortion (such as physical distortion of elasticity, viscosity or the like and distortion of mass balance in the molecule, the main chain of the binder or the pendant portion) which is produced when the toner particles are embedded in the toner image-receiving layer.

In the toner image-receiving layer, the plasticizer may be dispersed as microparticles, may undergo micro-phase separation in the form of islands, or may be completely mixed and dissolved together with other components such as the binder. The content of the plasticizer in the toner image-receiving layer is preferably 0.001 to 90% by mass, more preferably 0.1 to 60% by mass, still more preferably 1 to 40% by mass.

The plasticizer may also be used for the purposes of adjusting smoothness (improving transportability by reducing friction), reducing offset at the fixing part (separation of the toner or the layer to the fixing part), adjusting curl balance, or adjusting charge (forming a toner electrostatic image).

Filler

An organic or inorganic filler may be used, such as any known reinforcing agent for binder resins, any known bulking agent and any known impact strength modifier. The filler may be selected with reference to "*Handbook of Rubber and Plastics Additives*" (ed. Rubber Digest Co.), "*Plastics Blending Agents: Basic and Application*" (New Edition) (Taisei Co.), and "*The Filler Handbook*" (Taisei Co.). The filler may be any of various types of inorganic fillers (or pigments). Examples of the inorganic pigment include silica, alumina, titanium dioxide, zinc oxide, zirconium dioxide, micaceous iron oxide, white lead, lead oxide, cobalt oxide, strontium chromate, molybdenum pigments, smectite, magnesium oxide, calcium oxide, calcium carbonate, and mullite. Silica and alumina are particularly preferred. One of these fillers may be used alone, or two or more of these fillers may be used in combination. The filler preferably has a small particle diameter. If the particle diameter is too large, the surface of the toner image-receiving layer can tend to be rough.

Silica materials include spherical silica and amorphous silica. The silica may be synthesized by dry method, wet method or aerogel method. The surface of the hydrophobic silica particles may also be treated with trimethylsilyl or silicone. Colloidal silica is preferred. The average particle diameter of the silica is preferably from 4 to 120 nm, more preferably from 4 to 90 nm.

The silica is preferably porous. The average pore size of the porous silica is preferably from 50 to 500 nm. For example, the average pore volume per mass of the porous silica is preferably from 0.5 to 3 ml/g.

Alumina materials include anhydrous alumina and hydrated alumina. Any of anhydrous alumina crystal forms $\alpha$, $\beta$, $\gamma$, $\delta$, $\zeta$, $\eta$, $\theta$, $\kappa$, $\rho$, and $\chi$ may be used. Hydrated alumina is preferred to anhydrous alumina. The hydrated alumina may be a monohydrate or trihydrate. Examples of the monohydrate include pseudo-boehmite, boehmite and diaspore. Examples of the trihydrate include gibbsite and bayerite. The average particle diameter of the alumina is preferably from 4 to 300 nm, more preferably from 4 to 200 nm. Porous alumina is preferred. The average pore size of the porous alumina is preferably from 50 to 500 nm. The average pore volume per mass of porous alumina is around 0.3 to 3 ml/g.

The hydrated alumina can be synthesized by a sol-gel method in which alumina is precipitated by adding ammonia to an aluminum salt solution or by hydrolysis of an alkali aluminate. Anhydrous alumina can be obtained by heating and dehydrating alumina hydrate. The amount of the filler is preferably from 5 to 2000% by mass, based on the dry mass of the binder in the layer to which the filler is added.

Crosslinking Agent

The crosslinking agent can be added in order to adjust the storage stability or thermoplastic properties of the toner image-receiving layer. Examples of the crosslinking agent include compounds whose molecule carries two or more reactive groups each selected from an epoxy group, an isocyanate group, an aldehyde group, an active halogen group, an active methylene group, an acetylene group, and any other known reactive groups.

The crosslinking agent may also be a compound having two or more groups capable of forming a bond such as a hydrogen bond, an ionic bond, and a coordinate bond.

The crosslinking agent may be such a known compound as a resin coupling agent, a curing agent, a polymerizing agent, a polymerization promoter, a coagulant, a film-forming agent, and a film-forming assistant. Examples of the coupling agent include chlorosilanes, vinylsilanes, epoxysilanes, aminosilanes, alkoxyaluminum chelates, and titanate coupling agents. Any other known agents such as those disclosed in "*Handbook of Rubber and Plastics Additives*" (ed. Rubber Digest Co.) may also be used.

Charge Control Agent

The toner image-receiving layer preferably contains a charge control agent for controlling the transfer or adhesion of the toner or for preventing electrostatic adhesion of the toner image-receiving layer. Any known charge control agent may be used.

Examples of the charge control agent include a surfactant such as a cationic surfactant, an anionic surfactant, an amphoteric surfactant, and a nonionic surfactant; a polymer electrolyte; and an electrically-conductive metal oxide. Examples thereof include but are not limited to a cationic antistatic agent such as quaternary ammonium salts, polyamine derivatives, cation-modified poly(methyl methacrylate), and cation-modified polystyrene; an anionic antistatic agent such as alkyl phosphates and anionic polymers; and an nonionic antistatic agent such as polyethylene oxide.

If the toner has a negative charge, a cationic or nonionic charge control agent can preferably be added to the toner image-receiving layer-Examples of the electrically-conductive metal oxide include ZnO, $TiO_2$, $SnO_2$, $Al_2O_3$, $In_2O_3$, $SiO_2$, MgO, BaO, and $MoO_3$. Any of these electrically-conductive metal oxides may be used alone or in the form of a complex oxide. Any of these metal oxides may contain any other element. For example, ZnO may contain (or be doped with) Al, In or the like, $TiO_2$ may contain (or be doped with) Nb, Ta, or the like, and $SnO_2$ may contain (or be doped with) Sb, Nb, a halogen element, or the like.

Other Additives

Examples of the material for the toner image-receiving layer also include various types of additives for improving output image stability or improving the stability of the toner image-receiving layer itself. Examples of such additives include known materials for an antioxidant, an age resistor, an antidegradant, an antiozonant, an ultraviolet light absorber, a metal complex, a light stabilizer, a preservative, or a fungicide.

Examples of the antioxidant include chroman compounds, coumarane compounds, phenol compounds (such as hindered phenols), hydroquinone derivatives, hindered amine derivatives, and spiroindan compounds. The antioxidant is also disclosed in JP-A No. 61-159644.

Examples of the age resistor include those disclosed in "*Handbook of Rubber and Plastics Additives*" Second Edition (1993, Rubber Digest Co.), pp.76–121.

Examples of the ultraviolet light absorber include benzotriazol compounds (disclosed in U.S. Pat. No. 3,533,794), 4-thiazolidone compounds (disclosed in U.S. Pat. No. 3,352,681), benzophenone compounds (disclosed in JP-A No. 46-2784), and ultraviolet light absorbing polymers (disclosed in JP-A No. 62-260152).

Examples of the metal complex include those disclosed in U.S. Pat. Nos. 4,241,155, 4,245,018 and 4,254,195, and JP-A Nos. 61-88256, 62-174741, 63-199248, 01-75568, and 01-74272.

The ultraviolet light absorbers and the light stabilizers provided in "*Handbook of Rubber and Plastics Additives*" Second Edition (1993, Rubber Digest Co.), pp.122–137 may also preferably be used.

Any known photographic additive may also be added to the toner image-receiving layer material. Examples of the photographic additive include those disclosed in the *Journal of Research Disclosure* (hereafter referred to as RD) No. 17643 (December 1978), No. 18716 (November 1979) and No. 307105 (November 1989).

The toner image-receiving layer may be formed by a process including the steps of applying, to the support, a coating liquid that contains the polymer for forming the toner image-receiving layer by means of a wire coater or the like and drying the coating. For example, the coating liquid is prepared by dissolving or uniformly dispersing the thermoplastic polymer and additives such as the plasticizer in an organic solvent such as alcohol and ketone. Examples of the organic solvent include methanol, isopropyl alcohol and methyl ethyl ketone. If the polymer for forming the toner image-receiving layer is water-soluble, the toner image-receiving layer can be formed by applying an aqueous solution of the polymer to the support. If the polymer is not water-soluble, a water dispersion of the polymer may be applied to the support. In the inventive method, the polymer film-forming temperature is preferably room temperature or higher in terms of the storage before printing, and preferably 100° C. or lower in terms of the fixation of the toner particles.

The toner image-receiving layer is formed so as to have a post-drying coating mass of typically 1 to 20 g/m$^2$, preferably 4 to 15 g/m$^2$. The thickness of the toner image-receiving layer is typically from 1 to 20 μm, preferably from 4 to 15 μm.

The toner image-receiving layer preferably has a thickness of 1 to 30 μm, more preferably 2 to 20 μm but may have any other thickness.

Physical Properties of Toner Image-Receiving Layer

It is preferred that the toner image-receiving layer has a high degree of whiteness. A whiteness degree can be determined by the testing method for brightness by Hunter of paper and pulp and is preferably 85% or more. A spectral reflectance of the toner image-receiving layer is preferably 85% or more in a wavelength range from 440 nm to 640 nm. The difference between the maximum spectral reflectance and the minimum spectral reflectance is preferably 5% or less in the wavelength range. More preferably, the spectral reflectance is 85% or more in the wavelength range from 400 nm to 700 nm, and the difference between the maximum spectral reflectance and the minimum spectral reflectance is 5% or less in the same wavelength range. Concerning the whiteness degree, for example, the L* value is preferably 80 or more, more preferably 85 or more, still more preferably 90 or more in the CIE 1976 (L*a*b*) color space. The color tint of the whiteness is preferably as neutral as possible. Regarding the color tint of the whiteness, the value of (a*)2+(b*)2 is preferably 50 or less, more preferably 18 or less, still more preferably 5 or less in the (L*a*b*) space.

It is preferred that the toner image-receiving layer has high glossiness. In the overall area from the toner-free white part to the densest black part, the 45° gloss is preferably 60 or more, more preferably 75 or more, still more preferably 90 or more. However, the gloss is preferably 110 or less. If more than 110, the image can undesirably have metallic gloss. The gloss may be determined according to specular glossiness-measuring method.

It is preferred that the toner image-receiving layer has high smoothness. Concerning the smoothness, the arithmetic average roughness (Ra) is preferably 3 μm or less, more preferably 1 μm or less, still more preferably 0.5 μm or less, in the overall area from the toner-free white part to the densest black part. The arithmetic average roughness may be determined using borderline curve equation and a stylus-type surface irregularity measuring instrument or a light wave interference type surface irregularity measuring instrument.

The toner image-receiving layer preferably has a surface electrical resistance in the range from $1\times10^5$ to $1\times10^{15}$ Ω/cm$^2$ (under the conditions of 25° C. and 65% RH)

If the surface electrical resistance is less than $1\times10^6$ Ω/cm$^2$, an insufficient amount of the toner can be transferred to the toner image-receiving layer, so that the density of the resulting toner image can be low. On the other hand, if the surface electrical resistance is more than $1\times10^{15}$ Ω/cm$^2$, charge can excessively be generated during the transfer, so that: the toner can insufficiently be transferred; the density of the image can be low; static electricity can build up and cause adhesion of dust when the electrophotographic image-receiving sheet is handled; or misfeed, overfeed, discharge marks, or partial missing of the toner after the transfer can occur in the copy process.

The surface electrical resistance of the support surface opposite to the toner image-receiving layer is preferably from $5\times10^8$ to $3.2\times10^{10}$ Ω/cm$^2$, more preferably $1\times10^9$ to $1\times10^{10}$ Ω/cm$^2$.

The surface electrical resistances can be determined based on general methods for testing thermosetting plastics, wherein a sample is subjected to moisture control in an environment at a temperature of 20° C. and a humidity of 65% for 8 hours or more, and then in the same environment, the resistance is measured using R8340 (trade name, manufactured by Advantest Corporation) one minute after a voltage of 100 V is applied.

Other Layers

Examples of the other layers include a surface protective layer, a backing layer, an adhesion improving layer, an intermediate layer, an undercoat layer, a cushion layer, a charge control (antistatic) layer, a reflective layer, a tint adjusting layer, a storage stability improving layer, an anti-adhesion layer, an anti-curl layer, and a smoothing layer. Any of these layers may have a monolayer structure or a two- or more-layer structure.

Surface Protective Layer

The surface protective layer may be provided on the surface of the toner image-receiving layer for the purpose of: protecting the surface of the inventive electrophotographic recording sheet; increasing the storage stability; improving the handleability; providing writability; improving the transferability in the machine; or providing anti-offset properties. The surface protective layer may comprise one layer or two or more layers. The surface protective layer may contain any type of thermoplastic resin or thermosetting resin as a binder and preferably contains the same type of resin as that in the toner image-receiving layer. However, the thermodynamic or electrostatic properties of the protecting layer is not necessarily identical to those of the toner image-receiving layer, and may each be optimized.

The surface protective layer may contain any of the above various additives, if they are acceptable to the toner image-receiving layer. In particular, the surface protective layer may contain the release agent and any other additive such as the matting agent. Any known matting agent may be used. Preferably, the outermost surface of the inventive electrophotographic recording sheet (if the surface protective layer is provided, its surface) has good compatibility with the toner, in terms of fixation. For example, the molten toner preferably makes a contact angle of 0 to 40° with the surface.

Backing Layer

In a preferred mode, the backing layer is provided on the opposite side of the support from the toner image-receiving layer for the purpose of: providing suitability for output on the backside; improving the image output on the backside; improving the curl balance; or improving the transferability in the machine. The backing layer can be in any color, but preferably in white if the inventive electrophotographic recording sheet is a double-sided output type. The whiteness and the spectral reflectance of the backing layer are preferably 85% or more similarly to the front surface.

The structure of the backing layer may be the same as that of the toner image-receiving layer side, so that the suitability for the double-sided output can be improved. The backing layer may contain any of the above various additives. In particular, the matting agent or the charge control agent is suitably added to the backing layer. The backing layer may have a monolayer structure or a two- or more-layer structure. If a releasing oil is used in the fixing roller or the like in order to prevent offset during the fixing process, the backing layer may have oil absorption properties.

Adhesion Improving Layer

In the inventive electrophotographic recording sheet, the adhesion improving layer is preferably provided in order to increase the adhesion between the support and the toner image-receiving layer. The adhesion improving layer may contain any of the above various additives and in particular, may preferably contain the crosslinking agent. In addition, the cushion layer or the like is preferably provided between the adhesion improving layer and the toner image-receiving layer, so that the function of receiving the toner can be improved.

Intermediate Layer

The intermediate layer may be formed, for example, between the support and the adhesion improving layer, between the adhesion improving layer and the cushion layer, between the cushion layer and the toner image-receiving layer, or between the toner image-receiving layer and the storage stability improving layer. In the electrophotographic recording sheet comprising the support, the toner image-receiving layer and the intermediate layer, the intermediate layer may be provided between the support and the toner image-receiving layer.

The inventive electrophotographic recording sheet may have any thickness depending on the purpose and preferably a thickness of 50 to 350 μm, more preferably 100 to 280 μm.

Image Forming Apparatus

The image forming method of the invention is described below with reference to the image forming apparatus as shown in the drawings.

FIG. 1 is a schematic diagram showing a tandem type color image-forming apparatus 100 according to the invention. The color image-forming apparatus 100 receives color image information sent out from a personal computer or the like (not shown) or receives original color document image information read out from an image data input unit or an image reader (not shown) and processes the input image information.

Reference letters 1Y, 1M, 1C, and 1K represent electrophotographic image-forming units for forming a yellow image, a magenta image, a cyan image, and a black image, respectively. These units are serially arranged in the order of 1Y, 1M, 1C, and 1K in the moving direction of an intermediate transfer element 9, which is endless and tensioned by a plurality of tension rolls 10. The intermediate transfer element 9 is inserted between each electrostatic latent image carrier 2Y, 2M, 2C, or 2K and each transfer means 6Y, 6M, 6C, or 6K placed opposite to each other in each electrophotographic image-forming unit 1Y, 1M, 1C, or 1K. Reference letters 3Y, 3M, 3C, and 3K each represent an electrostatic charger for uniformly charging the surface of each carrier 2Y, 2M, 2C, or 2K. Reference letters 4Y, 4M, 4C, and 4K each represent an exposure unit for a yellow, magenta, cyan, or black toner image. Reference letters 5Y, 5M, 5C, and 5K each represent a development unit for developing the electrostatic latent image for a yellow, magenta, cyan, or black toner image. Reference letters 7Y, 7M, 7C, and 7K each represent an electrostatic latent image carrier cleaner for scraping the toner left on the carrier 2Y, 2M, 2C, or 2K after the transfer process. Reference letters 8Y, 8M, 8C, and 8K each represent a static eliminator for removing static electricity from the surface of the carrier 2Y, 2M, 2C, or 2K.

The operation for forming an image on the intermediate transfer element 9 is described by specifically showing the operation of the electrophotographic image-forming unit 1Y for making a yellow toner image.

The surface of the electrostatic latent image carrier 2Y is first uniformly charged. Exposure to light for a yellow image is then performed by the exposure unit 4Y so that an electrostatic latent image corresponding to the yellow image is formed on the carrier 2Y.

The electrostatic latent image corresponding to the yellow image is developed into a yellow toner image by the development unit 5Y. The yellow toner image is transferred onto the intermediate transfer element 9 by pressing force of a primary transfer roll 6Y and electrostatic attraction. The roll 6Y is part of primary transfer means. After the transfer, the yellow toner left on the carrier 2Y is scraped off by the cleaner 7Y. After the static electricity is removed from the surface of the carrier 2Y by the static eliminator 8Y, the surface is uniformly charged again by the charger 3Y for the next image forming cycle.

In the image forming apparatus 100 for multicolor image formation, each image forming process is carried out, similarly to the above, in each of the units 1M, 1C and 1K at timing depending on the difference in position of each of the units 1Y, 1M, 1C, and 1K, so that a full color toner image is formed on the intermediate transfer element 9.

The full color toner image formed on the intermediate transfer element 9 is transferred to an electrophotographic recording sheet 18, which is fed to the position for the secondary transfer at preset timing. The transfer is achieved through electrostatic attraction and pressing force of a backup roll 13 and a secondary transfer roll 12. The backup roll 13 supports the intermediate transfer element 9, and the secondary transfer roll 12 is part of secondary transfer means and pressing the backup roll.

Referring to FIG. 1, the electrophotographic recording sheet 18 in a preset size is fed by a paper feeding roll 17*a* from a paper feeding cassette 17, which is provided as a part for storing electrophotographic recording sheets at a lower position in the image forming apparatus 100. The electrophotographic recording sheet 18 is then fed by carrier rolls 19 and resist rolls 20 to the secondary transfer position in the intermediate transfer element 9 at preset timing. As shown above, the full color toner image is transferred all at once from the intermediate transfer element 9 to the electrophotographic recording sheet 18 through the backup roll 13 and the secondary transfer roll 12 which form the secondary transfer means.

The electrophotographic recording sheet 18 having the full color toner image, which is transferred from the intermediate transfer element 9, is separated from the element 9 and then fed to a first fixing unit 15, which is placed downstream from the secondary transfer means. In the first fixing unit 15, the toner image is fixed onto the electrophotographic recording sheet 18 by heat and pressure.

The toner not transferred to the sheet 18 and left on the element 9 is carried by the element 9 itself to an intermediate transfer element cleaner 14 and then removed from the element 9 by the cleaner 14 for the next image formation.

Figure 2:
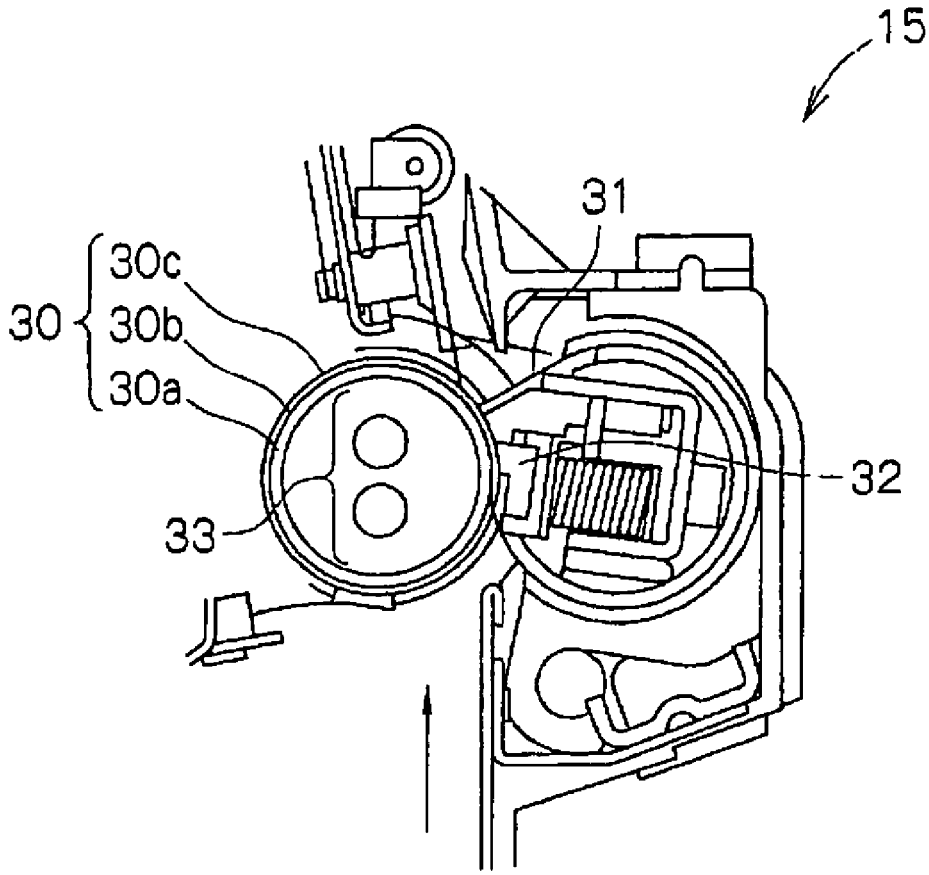
FIG. 2 is a schematic diagram showing an example of a first fixing unit for use in the method of the invention.

Referring to FIG. 2, the first fixing unit 15 is a press belt type and comprises a fixing roll 30 with a small heat capacity, a press belt 31 and a press pad 32.

The fixing roll 30 comprises an aluminum core 30*a* with a thickness of 1.5 mm, an outer diameter of 25 mm and a length of 380 mm; a coating of an elastomer layer 30*b* with which the surface of the core 30*a* is covered and which is made of a silicone rubber with a rubber hardness of 330 and has a thickness of 0.5 mm and a length of 320 mm; and a releasing layer 30*c* that is placed over the surface of the elastomer layer 30*b* and formed of a PFA tube with a thickness of 30 μm. Inside the fixing roll 30, 650 W halogen lamps 33 are provided as a heat source, with which the surface of the fixing roll 30 is heated from the inside to have a preset temperature (generally a temperature of 140 to 190° C. depending on the melting point of the toner)

The press belt 31 comprises a polyimide belt with a thickness of 75 μm, an outer diameter of 30 mm and a length of 330 mm; and a releasing layer that is placed over the surface of the polyimide belt and formed of a 30 μm thick PFA tube. Inside the press belt 31, the press pad 32 is placed, which presses the press belt 31 to the fixing roll 30 and forms a nip. The press load of the press pad 32 is 33 kg, and the width of the nip is 6.5 mm. No heat source is provided on the press belt 31 side or the press pad 32 side.

The image forming apparatus 100 has an electrophotographic recording sheet-feeding route 11 in its side part. The route 11 is provided in the substantially vertical direction.

In such a substantially vertical route 11, the electrophotographic recording sheet 18 is subjected to image formation and fixation and then discharged to the upper portion of the image forming apparatus. Therefore, a second fixing unit 101 can be placed between the apparatus 100 and the image reader (not shown) with no additional route for feeding the electrophotographic recording sheet.

The image forming apparatus 100 can be operated in a first printing mode (normal printing mode) or a second printing mode (high glossiness printing mode or photographic mode). When the normal printing mode is selected for a low or no gloss image, a sheet of normal paper or coated paper is selectively fed from the paper feeding cassette 17. The full color toner image is transferred by the secondary transfer means and fixed onto the sheet in the first fixing unit 15. The feeding route is then set on a first port 21 for discharging the electrophotographic recording sheet by means of a feeding direction-switching gate 16, and the sheet is discharged through discharge rolls 22 onto a normal paper mode delivery tray 25 with the formed image facing upside.

Figure 3:
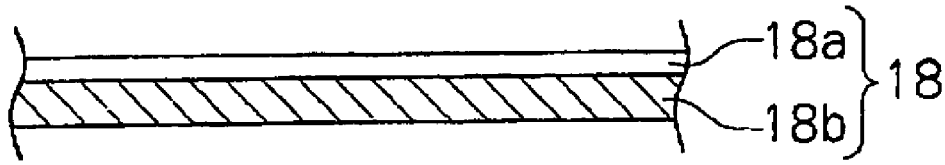
FIG. 3 is a schematic diagram showing an example of an electrophotographic recording sheet for use in a photographic mode according to the method of the invention.

Referring FIG. 3, the electrophotographic recording sheet 18 used in the second printing mode is described in detail below.

The inventive electrophotographic recording sheet is employed as the sheet 18 for the second printing mode. The sheet 18 comprises a support 18*b* and an image-receiving layer 18*a*, for example 10 μm in thickness, mainly composed of a thermoplastic resin such as polyester and formed on one side (surface) of the support 18*b*. In this mode, gloss can be uniformly produced over the whole area of this sheet. Normal paper or coated paper may be used in the photographic mode, though gloss can be reduced in the area other than the toner image portion in such a case.

Figure 4:
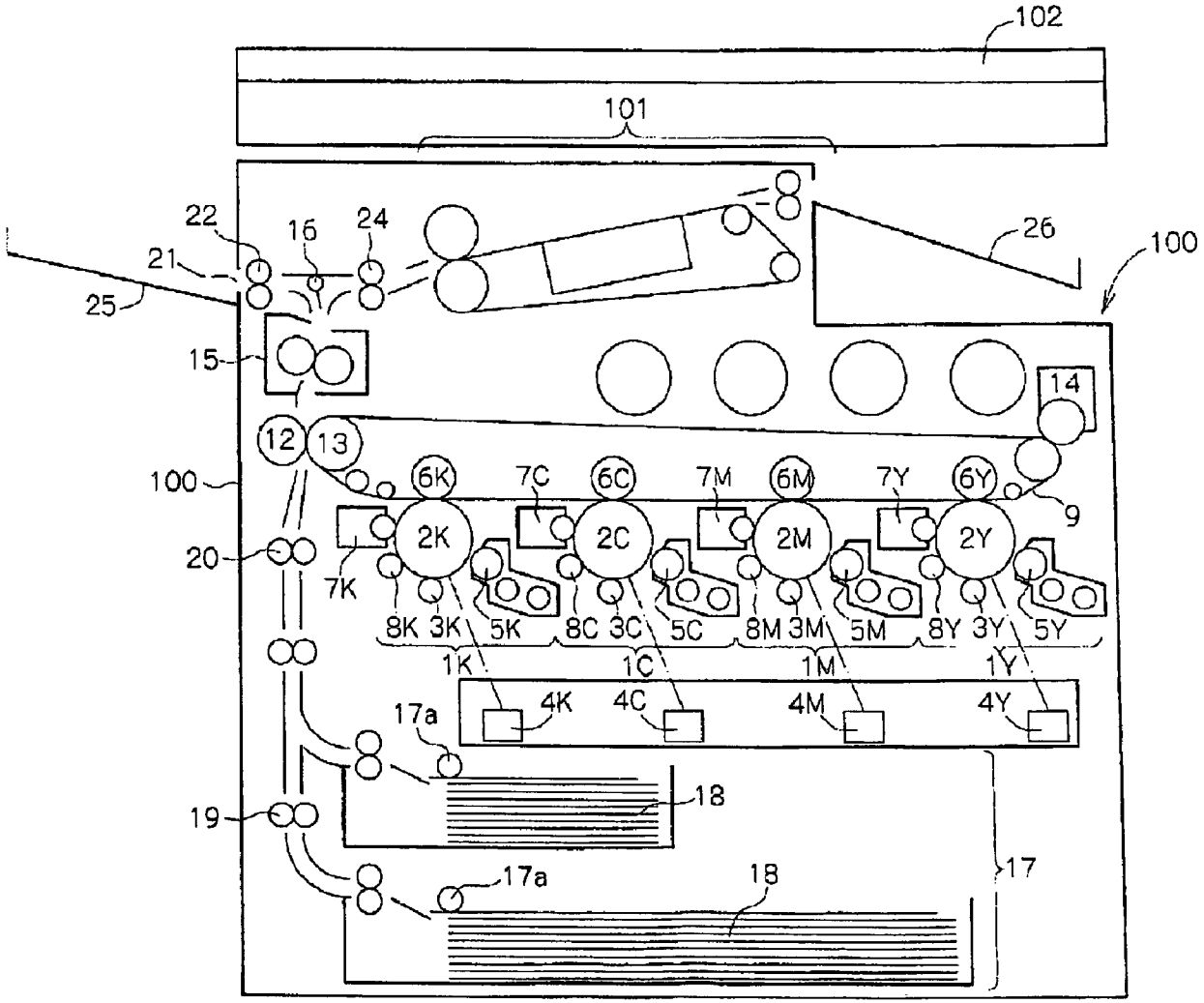
FIG. 4 is a schematic diagram showing an example of an image forming apparatus for use in the method of the invention.
Figure 5:
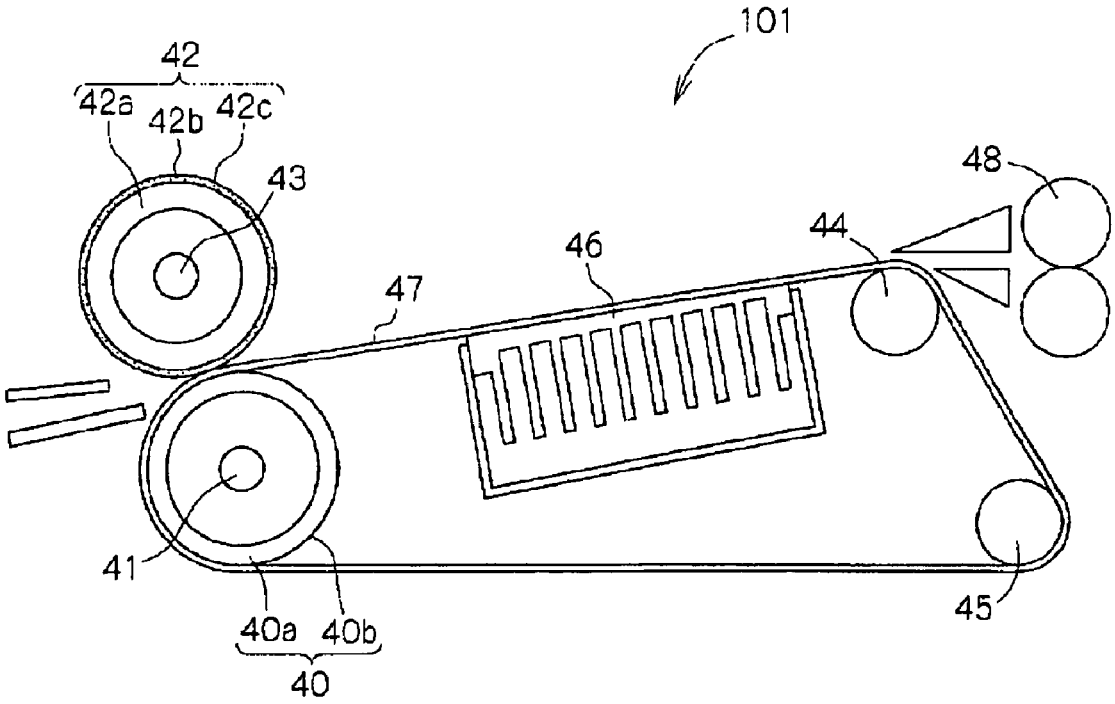
FIG. 5 is a schematic diagram showing an example of a second fixing unit for use in the method of the invention.

Referring to FIGS. 4 and 5, the second fixing unit 101 used in the second printing mode is described in detail below.

Referring to FIG. 4, the second fixing unit 101 is placed between the image forming apparatus 100 and the image reader 102 and integrally formed with the apparatus 100.

Referring to FIG. 5, the second fixing unit 101 comprises a heat fixing roll 40 having a heat source; a separation roll 44; a steering roll 45; a fixing belt 47 placed around these rolls; a press roll 42 that presses the heat fixing roll 40 via the fixing belt 47 and forms a nip; and a cooler 46 for cooling the fixing belt 47 downstream from the nip in the moving direction of the fixing belt 47. The toner-carrying electrophotographic recording sheet 18 is fed in such a manner that the toner image is brought into contact with the fixing belt 47, so that the toner image is fixed by heat and pressure. The fixing belt 47 and the electrophotographic recording sheet 18 are then cooled by the cooler 46, and then the sheet 18 is separated from the belt 47.

The heat fixing roll 40 comprises a metallic core 40*a* with high thermal conductivity; and a releasing layer 40*b* that is placed over the surface of the core 40*a* and formed of a fluororesin layer such as a PFA tube. Inside the core 40*a*, a heat source 41 such as a halogen lamp is provided to heat the surface of the heat fixing roll 40 to a preset temperature, whereby the fixing belt 47 and the electrophotographic recording sheet 18 having the toner image are heated.

The press roll 42 comprises a metallic core 42*a* with high thermal conductivity; a coating of an elastomer layer 42*b* that is formed around the core 42*a* and made of a silicone rubber with a rubber hardness of about 400 or the like; and a releasing layer 42*c* that is formed on the surface of the elastomer layer 42*c* and made of a fluororesin layer such as a PFA tube. Inside the core 42*a*, a heat source 43 such as a halogen lamp is provided to heat the surface of the press roll 42 to a preset temperature, whereby the electrophotographic recording sheet 18 is heated from the backside while pressed by the roll 42.

The heat fixing roll 40 or the press roll 42 may have any other structure, as long as it enables the fixation of the toner image onto the electrophotographic recording sheet 18 via the fixing belt 47.

In the separation mechanism, the separation roll 44 allows the electrophotographic recording sheet 18 to peel off from the fixing belt 47 by the stiffness of the sheet 18 itself. The outside shape (outer diameter) of the separation roll 44 is determined by the adhesion strength between the fixing belt 47 and the sheet 18 and the contact angle which the fixing belt 47 forms with the separation roll 44.

The steering roll 45 is provided to prevent breakage of the belt edge, which would otherwise be caused by a shift of the moving fixing belt 47. While one end of the axis of the roll 45 is fixed, the other end is supported on a driving unit (not shown) so that the axis can be tilted relative to the heat fixing roll 40, whereby the fixing belt 47 can return from the shifted position.

The cooler 46 is provided in contact with the fixing belt 47 to cool the electrophotographic recording sheet 18. The cooler 46 faces the inner side of the fixing belt 47 and is placed downstream from the heat fixing roll 40 and upstream from the separation roll 44. The cooler 46 is in contact with the inner side of the fixing belt 47 so as to absorb the heat from the fixing belt 47. The cooler 46 cools the toner image and the image-receiving layer 18*a* fused by the heat fixing roll 40 and the press roll 42 at the surface of the electrophotographic recording sheet 18*a*, so that the overall surface of the image is solidified in a smooth state according to the surface of the fixing belt 47. Thus, high glossiness printing can be achieved.

The fixing belt 47 comprises an endless film made of thermosetting polyimide; and a coating of a 35 μm thick silicone rubber layer or the like which is placed on the film and has a smooth surface. In terms of electrical power consumption, the belt is preferably as thin as possible. In terms of strength, however, the polyimide base should have a thickness of 75 μm or more. In terms of close contact with the toner image on the electrophotographic recording sheet, the silicone rubber layer should have a thickness of 30 μm or more. In terms of image quality and reliability, the fixing belt preferably expands as little as possible during heating and preferably has a coefficient of linear expansion of $1\times10^{-6}$/° C. or less. The coefficient of linear expansion is determined from the expansion of a sample, which is allowed to expand at a heating rate of 5° C./min in the measurement temperature range from 25° C. to 200° C. under a load of 1 g in a measuring apparatus (TMA7000 (trade name) manufactured by Shinku-Riko Inc. (now known as ULVAC-Riko Inc.). The sample size is 5 mm in width and 15 mm in length. The fixing belt 47 is looped over the heat fixing roll 40, the separation roll 44 and the steering roll 45 and driven by the heat fixing roll 40.

When the second printing mode is selected, the feeding route and the operation process from the image formation to the discharge are as shown below.

In the second printing mode, the image forming process is performed similarly to that in the normal printing mode, so that a full color toner image is formed on the intermediate transfer element 9. The electrophotographic recording sheet 18 for the second printing mode is selectively fed from the paper feeding cassette 17. The full color toner image is transferred by the secondary transfer means and fixed onto the sheet 18 in the first fixing unit 15. The feeding route is then set on the second fixing unit 101 side by means of a feeding direction-switching gate 16, so that the sheet 18 is fed through carrier rolls 24 to the second fixing unit 101.

Figure 6:
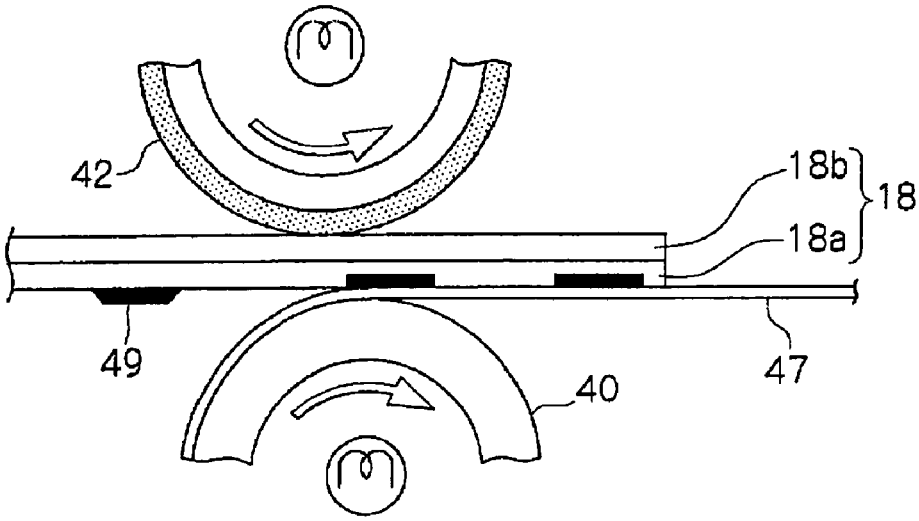
FIG. 6 is a diagram showing an example of a photographic mode process in the second fixing unit used in the method of the invention.

Referring to FIG. 6, the toner 49 on the sheet 18 is then embedded into the image-receiving layer 18*a* of the sheet 18 by the press roll 42 and the fixing belt 47 placed around the heat fixing roll 40 in the second fixing unit 101. The sheet 18 adhering to the fixing belt 47 is then transported and cooled to a preset temperature by the cooler 46. The cooled sheet 18 is separated from the fixing belt 47 at the separation roll 44 and discharged through discharge rolls 48 onto a photographic mode delivery tray 26 with the formed image facing downside.

Before sent to the second fixing unit, the toner 49 is already fixed onto the electrophotographic recording sheet 18 by the first fixing unit 15 in the image forming apparatus 100. Therefore, image quality defect such as an irregular image can be prevented, even when the image surface comes into contact with the supporting member for feeding or the like upon switching by the feeding direction-switching gate 16.

EXAMPLES

The present invention is more specifically described with reference to the examples below, but such examples are not intended to limit the scope of the invention.

Preparation of Base Paper

Base Paper 1

To 100 parts by mass of LBKP pulp (with a freeness (CSF) of 470 ml) as a base material are added 10 parts by mass of precipitated calcium carbonate light (TP121 (trade name) manufactured by Okutama Kogyo Co., Ltd.), 0.08 parts by mass of alkenyl succinic anhydride (Fibran 81 (trade name) manufactured by National Starch and Chemical Company) as an-internal sizing agent and 0.5 parts by mass of cationized starch (Ace K (trade name) manufactured by Oji Cornstarch Co., Ltd.).

The resulting stuff is fed to a wire multi-pipe type paper machine and formed into base paper (named Base Paper 1) with a final water content of 5% by mass, a fiber orientation ration of 1.1 and a basis weight of 160 g/m$^2$.

Base Paper 2

To 100 parts by mass of LBKP pulp (with a freeness (CSF) of 400 ml) as a base material are added 10 parts by mass of precipitated calcium carbonate light (TP121 (trade name) manufactured by Okutama Kogyo Co., Ltd.), 0.08 parts by mass of alkenyl succinic anhydride (Fibran 81 (trade name) manufactured by National Starch and Chemical Company) as an internal sizing agent and 0.5 parts by mass of cationized starch (Ace K (trade name) manufactured by Oji Cornstarch Co., Ltd.).

The resulting stuff is fed to a wire multi-pipe type paper machine and formed into base paper (named Base Paper 2) with a final water content of 5% by mass, a fiber orientation ration of 1.5 and a basis weight of 160 g/m$^2$.

Base Paper 3

To 100 parts by mass of LBKP pulp (with a freeness (CSF) of 400 ml) as a base material are added 10 parts by mass of precipitated calcium carbonate light (TP121 (trade name) manufactured by Okutama Kogyo Co., Ltd.), 0.08 parts by mass of alkenyl succinic anhydride (Fibran 81 (trade name) manufactured by National Starch and Chemical Company) as an internal sizing agent and 0.5 parts by mass of cationized starch (Ace K (trade name) manufactured by Oji Cornstarch Co., Ltd.).

The resulting stuff is fed to a wire multi-pipe type paper machine and formed into base paper (named Base Paper 3) with a final water content of 5% by mass, a fiber orientation ration of 1.8 and a basis weight of 160 g/m$^2$.

Preparation of Electrophotographic Recording Sheet with Laminated Support

Examples 1 and 2 and Comparative Examples 1 and 2

Preparation of Laminated Support

Laminated Support 1

Base Paper 1 is used to produce a laminated support. A blend of high density polyethylene (HDPE) and low density polyethylene (LDPE) in a mass ratio of 7:3 is used to form a backside PE layer with a thickness of 20 μm on the back surface of Base Paper 1 by extrusion coating process (at 310° C.). LDPE is then used to form a front side PE layer with a thickness of 35 μm on the front surface of Base Paper 1 in a similar manner, so that polyethylene laminated paper (named Laminated Support 1) is prepared.

Laminated Support 2

Base Paper 2 is used to produce a laminated support. A blend of high density polyethylene (HDPE) and low density polyethylene (LDPE) in a mass ratio of 7:3 is used to form a backside PE layer with a thickness of 20 μm on the back surface of Base Paper 2 by extrusion coating process (at 310° C.). LDPE is then used to form a front side PE layer with a thickness of 35 μm on the front surface of Base Paper 2 in a similar manner, so that polyethylene laminated paper (named Laminated Support 2) is prepared.

Laminated Support 3

Base Paper 3 is used to produce a laminated support. A blend of high density polyethylene (HDPE) and low density polyethylene (LDPE) in a mass ratio of 7:3 is used to form a backside PE layer with a thickness of 14 μm on the back surface of Base Paper 3 by extrusion coating process (at 310° C.). LDPE is then used to form a front side PE layer with a thickness of 30 μm on the front surface of Base Paper 3 in a similar manner, so that polyethylene laminated paper (named Laminated Support 3) is prepared.

Laminated Support 4

Base Paper 2 is used to produce a laminated support. A blend of high density polyethylene (HDPE) and low density polyethylene (LDPE) in a mass ratio of 7:3 is used to form a backside PE layer with a thickness of 14 μm on the back surface of Base Paper 2 by extrusion coating process (at 310° C.). LDPE is then used to form a front side PE layer with a thickness of 30 μm on the front surface of Base Paper 2 in a similar manner, so that polyethylene laminated paper (named Laminated Support 4) is prepared.

Formation of Undercoat Layer on Front Surface of Laminated Support

The composition as shown below is applied by a wire coater to the front surface of each of Laminated Supports 1, 2, 3, and 4 so as to give a post-drying coating amount of 0.1 g/m$^2$, and dried, so that a front-side undercoat layer is formed.

The composition for the front-side undercoat layer has the following composition: 5 parts by mass of gelatin and 95 parts by mass of water.

Formation of Layer on Back Surface of Laminated Support

The composition as shown below is applied by a wire coater to the back surface of each of Laminated Supports 1, 2, 3, and 4 each with the front-side undercoat layer so as to give a post-drying coating amount of 5 g/m$^2$, and dried.

The composition for the backside layer has the following composition: 100 parts by mass of aqueous acrylic resin (Hiros XBH-997L (trade name) (with a solid content of 28.3% by mass) manufactured by SEIKO PMC CORPORATION), 4.5 parts by mass of paraffin wax (Hydrin D-337 (trade name) (with a solid content of 30% by mass) manufactured by Chukyo Yushi Co., Ltd.) and 33 parts by mass of ion-exchanged water.

Formation of Toner Image-Receiving Layer

The composition for the toner image-receiving layer as shown below is applied by a wire coater to each of Laminated Supports 1, 2, 3, and 4 each with the front-side undercoat layer and the backside layer so as to give a post-drying thickness of 10 μm, and dried, so that an electrophotographic recording sheet of Example 1 or 2 or Comparative Example 1 or 2 is prepared.

The composition for the toner image-receiving layer has the following composition: 100 parts by mass of a water dispersion of polyester resin (Elitel KZA-1449 (trade name) (with a solid content of 30% by mass and an incipient fluidization temperature of 100.4° C.) manufactured by Unitika Ltd.), 5 parts by mass of a carnauba wax release agent (trade name: EMUSTAR-0413, manufactured by Nippon Seiro Co., Ltd.) and 7.5 parts by mass of a water dispersion of a white pigment ($TiO_2$).

Preparation of Electrophotographic Recording Sheet with Coated Paper Support

Example 3 and Comparative Examples 3 and 4

Preparation of Coated Paper Support

Preparation of Coating Liquid

In a dispersing machine, 58 parts (solid content) by mass of kaolin (UW-90 (trade name) manufactured by Engelhard Corporation), 42 parts by mass of precipitated calcium carbonate light (Univer 70 (trade name) manufactured by Shiraishi Kogyo Co., Ltd.) and 0.3 parts (solid ratio to the pigment) by mass of sodium polyacrylate (Aron A-9 (trade name) manufactured by Toagosei Co., Ltd.) as a dispersing agent are dispersed in water to form a pigment slurry. To the pigment slurry are added 3.0 parts by mass of oxidized starch (Ace A (trade name) manufactured by Oji Cornstarch Co., Ltd.) and 15 parts by mass of styrene-butadiene copolymer latex (OX1060 (trade name) manufactured by Nippon Zeon Co., Ltd.) and stirred. Water is further added, so that a coating liquid is prepared with a solid content of 40%.

Formation of Coating Layer on Base Paper (Preparation of Coated Paper)

The resulting coating liquid is applied by a bar coater to both sides of each of Base Paper 1, 2 and 3 so as to give a dry weight of 20 g/m$^2$ per one side, and dried. The paper is then passed through a pressure nip composed of a metal roll and an elastic roll so as to have a smooth surface, resulting in coated paper with a basis weight of 200 g/m$^2$, a water content of 5% and a smoothness of about 6000 to about 7000 seconds.

Formation of Toner Image-Receiving Layer

The composition for the toner image-receiving layer as shown below is applied by a wire coater to the coated paper (composed of Base Paper 1, 2 or 3 and the coating layer) so as to give a post-drying thickness of 10 μm, and dried, so that an electrophotographic recording sheet of Example 3 or Comparative Example 3 or 4 is prepared.

The composition for the toner image-receiving layer has the following composition: 100 parts by mass of a water dispersion of polyester resin (Elitel KZA-1449 (trade name) (with a solid content of 30% by mass and an incipient fluidization temperature of 100.4° C.) manufactured by Unitika Ltd.), 5 parts by mass of a carnauba wax release agent (trade name: EMUSTAR-0413, manufactured by Nippon Seiro Co., Ltd.) and 7.5 parts by mass of a water dispersion of a white pigment ($TiO_2$).

Evaluation of Electrophotographic Recording Sheet

In a color laser printer with the same mechanism as shown in FIG. 1 (DocuCentre Color400cp manufactured by Fuji Xerox Co., Ltd.), a certain image is transferred and fixed onto the electrophotographic recording sheet prepared in each Example or Comparative Example. Another fixing process is then performed using the belt cooling separation type fixing unit as shown in FIG. 5. Uniformity of gloss of the image portion and the toner image-receiving layer is then evaluated. The results are shown in Tables 1 and 2.

The belt cooling separation type fixing unit in operation has a nip width of 6.0 mm, a heat roller temperature of 140° C., a press roller temperature of 140° C., a fixing speed of 60 mm/s, and a cooling temperature of 55° C. A portrait of a lady is used for making the print.

Evaluation of Uniformity of Gloss of Image Area and Toner Image-Receiving Layer Area The evaluation is visually made according to the criteria below. It is determined that "◎" and "○" are allowable levels and that "Δ" and "X" are not allowable. The criteria for the evaluation are as follows:

◎: Both of the image portion and the toner image-receiving layer have uniform gloss without any small irregularity of surface;

○: Both of the image portion and the toner image-receiving layer have uniform gloss but have some small irregularity of surface;

Δ: Gloss is reduced at some edge portions of the recording sheet; and

X: Portions reduced in gloss are found over the whole area of the recording sheet.

TABLE 1

| Laminated Support | Specifications of Base Paper: Type | Fiber Orientation Ratio | Freeness of Pulp (ml) | Laminated Thickness (μm): Image-Receiving Layer Side | Backside | 25–125° C. CD Shrinkage Percentage (%) | Uniformity of Gloss of: Image Portion and Toner Image-Receiving Layer Portion |
|---|---|---|---|---|---|---|---|
| Example 1 | Base paper 1 | 1.1 | 470 | 30 | 14 | 0.25 | ◎ |
| Example 2 | Base paper 2 | 1.5 | 380 | 35 | 20 | 1.2 | ◎ |
| Comparative Example 1 | Base paper 3 | 1.8 | 380 | 30 | 14 | 1.6 | X |
| Comparative Example 2 | Base paper 2 | 1.5 | 380 | 30 | 14 | 1.4 | Δ |

TABLE 2

| Coated Paper Support | Specifications of Base Paper: Type | Fiber Orientation Ratio | Freeness of Pulp (ml) | Amount of Coating Layer (g/m$^3$): Image-Receiving Layer Side | Backside | 25–125° C. CD Shrinkage Percentage (%) | Uniformity of Gloss of: Image Portion and Toner Image-Receiving Layer Portion |
|---|---|---|---|---|---|---|---|
| Example 3 | Base paper 1 | 1.1 | 470 | 20 | 20 | 0.3 | ○ |
| Comparative Example 3 | Base paper 2 | 1.5 | 380 | 20 | 20 | 1.5 | Δ |
| Comparative Example 4 | Base paper 3 | 1.8 | 380 | 20 | 20 | 1.7 | X |

The results in Tables 1 and 2 show that when the electrophotographic recording sheet used in the image forming process including the heat and cooling type fixing step comprises a cellulose pulp paper support and a toner image-receiving layer that is formed on the support and made of a thermoplastic resin, both of the resulting image portion and the resulting toner image-receiving layer can have uniform gloss without any small irregularity of surface.

According to the invention, as described above, a photo-realistic printed image can be produced with high and uniform gloss of the toner image-receiving layer and the image portion.

What is claimed is:

1. An image forming method, comprising:

transferring a toner image to an electrophotographic recording sheet;

layering the electrophotographic recording sheet on a fixing belt and heating and pressing the sheet; and cooling the electrophotographic recording sheet and separating the sheet from the fixing belt, wherein the electrophotographic recording sheet comprises a support comprising cellulose pulp-containing base paper and a toner image-receiving layer comprising a thermoplastic resin disposed on the support, and wherein a shrinkage percentage of the electrophotographic recording sheet in a CD direction in the heating step is 1.3% or less.

2. An image forming method according to claim 1, wherein a water content of the base paper is in a range from 4.5% to 5.5%.

3. An image forming method according to claim 1, wherein a fiber orientation ratio of the base paper is 1.2 or less.

4. An image forming method according to claim 1, wherein the shrinkage percentage in the CD direction is 0.8% or less.

5. An image forming method according to claim 1, wherein a thermal conductivity of the support is at least 0.50 kcal/m·h·° C. under conditions of 20° C. and a relative humidity of 65%.

6. An image forming method according to claim 1, wherein the support has a polyolefin-containing layer on one or both sides thereof.

7. An image forming method according to claim 6, wherein a water content of the base paper is in a range from 4.5% to 5.5%.

8. An image forming method according to claim 6, wherein a fiber orientation ratio of the base paper is 1.2 or less.

9. An image forming method according to claim 6, wherein the shrinkage percentage in the CD direction is 0.8% or less.

10. An image forming method according to claim 6, wherein the support has a thermal conductivity of at least 0.50 kcal/m·h·° C. under conditions of 20° C. and a relative humidity of 65%.

11. An image forming method according to claim 6, wherein the polyolefin-containing layer includes at least one layer that contains high density polyethylene and low density polyethylene.

12. An image forming method according to claim 11, wherein a blend ratio of the high density polyethylene and the low density polyethylene in the layer that contains the high density polyethylene and the low density polyethylene is 3/7 to 7/3 by mass.

13. An image forming method according to claim 1, wherein the support further has a coating that contains at least one selected from the group consisting of kaolin, a pigment, a resin, a rubber latex, or a polymer material and coated on one or both surfaces of the base paper.

14. An image forming method according to claim 13, wherein a water content of the base paper is in a range from 4.5% to 5.5%.

15. An image forming method according to claim 13, wherein a fiber orientation ratio of the base paper is 1.2 or less.

16. An image forming method according to claim 13, wherein the shrinkage percentage in the CD direction is 0.8% or less.

17. An image forming method according to claim 13, wherein the support has a thermal conductivity of at least 0.50 kcal/m·h·° C. under conditions of 20° C. and a relative humidity of 65%.

* * * * *